US006754983B2

(12) United States Patent
Hatfield et al.

(10) Patent No.: US 6,754,983 B2
(45) **Date of Patent: *Jun. 29, 2004**

(54) ARTICLE OF FOOTWEAR INCLUDING A TENTED UPPER

(75) Inventors: Tinker L. Hatfield, Portland, OR (US); Michael A. Aveni, Lake Oswego, OR (US); Micheal R. Friton, Portland, OR (US); Robert W. Dolan, Portland, OR (US); S. H. Park, Portland, OR (US)

(73) Assignee: Nike, Inc., Beaverton, OR (US)

( * ) Notice: Subject to any disclaimer, the term of this patent is extended or adjusted under 35 U.S.C. 154(b) by 105 days.

This patent is subject to a terminal disclaimer.

(21) Appl. No.: 10/051,371

(22) Filed: Jan. 22, 2002

(65) Prior Publication Data

US 2002/0124436 A1 Sep. 12, 2002

Related U.S. Application Data

(63) Continuation-in-part of application No. 09/626,139, filed on Jul. 26, 2000, now Pat. No. 6,367,168.

(51) Int. Cl.[7] ..... A43B 13/38; A43B 13/22; A43B 3/24; A43B 7/06; A43B 23/00

(52) U.S. Cl. ..... 36/45; 36/72 R; 36/96; 36/101; 36/38; 36/7.1 R

(58) Field of Search ..... 36/11.5, 45, 49, 36/51, 55, 56, 57, 58.6, 72 R, 73–96, 101, 3 A, 7.1 R, 7.3, 50.1

(56) References Cited

U.S. PATENT DOCUMENTS 2,836,909 A * 6/1958 Richards ..... 36/72 R
5,065,531 A * 11/1991 Prestridge ..... 36/101
5,144,759 A * 9/1992 Mascotte ..... 36/71 R
5,337,491 A * 8/1994 Mascotte ..... 36/7.1 R
5,365,677 A * 11/1994 Dalhgren ..... 36/3 A
5,678,325 A * 10/1997 Davidowitz et al. ..... 36/11.5
5,765,296 A * 6/1998 Ludemann et al. ..... 36/50.1
6,052,921 A * 4/2000 Oreck ..... 36/50.1
6,088,936 A * 7/2000 Bahl ..... 36/50.1
6,367,168 B1 * 4/2002 Hatfield et al. ..... 36/45
6,505,424 B2 * 1/2003 Oorei et al. ..... 36/50.1

FOREIGN PATENT DOCUMENTS

WO WO 95/22917 * 8/1995 ..... A43C/1/00

* cited by examiner

*Primary Examiner*—Anthony D. Stashick
(74) *Attorney, Agent, or Firm*—Banner & Witcoff, Ltd.

(57) ABSTRACT

An article of footwear has an upper in a tented arrangement. The article of footwear includes a sole and an upper including a shroud. The article of footwear further includes a foot engaging system for joining a foot of a user to the sole, and a biasing system which includes one or more frame members that urges or influences the shroud away from the foot of the user. The one or more frame members may be coupled to the foot holding system on a medial and a lateral side. The article of footwear further includes a plurality of straps for holding the foot to the sole in which one of the straps engages the heel. The straps are located on an exterior surface of the shroud or alternatively they are located in the interior of the shroud. Air gaps are created between the shroud and the foot for ventilation. Several foot booties for holding a foot have aeration regions for providing air to ventilate the foot of a wearer. Further, the foot booties are combined with straps, in which the straps are disposed between the shroud and the foot booties. The upper has a flexible sheet of material that is interconnected with a plurality of frame members that urges the sheet away from the foot of a wearer. The upper may be removable and replaceable with the sole.

44 Claims, 16 Drawing Sheets

ARTICLE OF FOOTWEAR INCLUDING A TENTED UPPER

CROSS-REFERENCE TO RELATED APPLICATION

The present continuation-in-part patent application claims priority to U.S. patent application Ser. No. 09/626,139, filed Jul. 26, 2000, which is herein incorporated by reference.

FIELD OF THE INVENTION

This invention relates to an article of footwear, especially for athletic shoes. More particularly, the invention relates to a comfortable, lightweight athletic shoe with an upper having a covering and a supporting framework for creating a tent-like structure.

BACKGROUND OF THE INVENTION

Proper fitting and comfortable shoes are important for foot development and athletic performance. One function of a shoe is to support and protect the foot. To this end, a shoe, typically an athletic shoe, includes a sole to provide traction, support and cushioning. A shoe also includes an upper that is typically stitched and/or glued to the upper periphery of the sole. The upper is intended to contact and hold the foot of the wearer to the sole, to provide a tight and comfortable fit. The upper typically also has a fastening system, such as a lace and eyelets in the upper material. The ends of the lace are tied together so the upper squeezes the foot within the shoe.

Uppers are frequently constructed of leather and other materials having properties similar to leather. Leather and other similar materials may retain moisture and do not permit the foot to readily breathe. The foot may generate an excessive amount of moisture, may become hot or overheated in an upper made of leather or similar materials. When an athletic shoe is used in hot weather, the temperature and moisture within the interior space of the upper may become elevated. This problem will effect the overall comfort and the fit of the shoe for the wearer. Further, these materials are relatively heavy making them unsuitable for certain athletic shoes, such as running shoes.

The disadvantages of leather and leather-like materials for shoe upper construction led to the development of uppers constructed at least in part of various synthetic materials. Most of these synthetic materials are polymer meshes that are light and breathable. Meshes can be advantageous in athletic shoes where a lightweight shoe is important to the athlete's performance during athletic activities, e.g., running and walking events. The mesh also allows the foot to breathe thereby keeping the foot relatively dry during athletic activities. However, the breathability of mesh materials can be improved if they are not contacting the surface of the foot or if a small portion of the material is contacting a foot.

One approach to providing air circulation to the foot is disclosed in U.S. Pat. No. 757,424 to Vohl. This patent discloses a lining that is placed inside of a shoe forming gaps between the lining and the upper material. The lining includes ribs fastened to the outer surface of the lining. This structure provides for air to flow within the gaps with the intent to ventilate the shoe. While Vohl has ribs fastened to the lining material, the system is used within an upper of a shoe. The lining reduces the interior space within the upper thereby undesirably reducing the shoe size and potentially causing the wearer discomfort at the skin because the foot will be rubbing or sensing the ribs within the upper. While alleging to provide increased air circulation to the foot, this lining does not appear to be suitable for a lightweight athletic shoe.

Sandals and similar footwear provide for support of the foot. These types of footwear leave the foot or at least the forefoot portion of the foot exposed. While these types of footwear provide for air circulation around the foot, because the foot is exposed, they may not provide suitable protection for the foot. The foot may be injured by debris or sunlight ultraviolet rays may damage the exposed foot. Additionally, sandals and similar type of footwear are not typically designed for athletic activities, such as running or cross-training.

Accordingly, an improved shoe upper for an article of footwear was needed to overcome the problems in the prior art.

SUMMARY OF THE INVENTION

The present invention is directed to an article of footwear having an upper in a tented arrangement to solve the problems in the prior art.

One aspect of the present invention is an article of footwear, such as an athletic shoe. The article of footwear includes a sole for engaging a ground surface and an upper including a shroud. The article of footwear further includes a foot engaging system for holding a foot of a user to the sole, and at least one frame member that urges or influences the shroud away from the foot of the user. The article of footwear further includes a plurality of straps for holding the foot to the sole in which one of the straps engages the heel. In another aspect of the present invention, straps are located on an exterior surface of the shroud in which multiple air gaps are created for cooling the foot. In another aspect of the present invention the straps are located interior of the shroud for creating a substantial air gap for air to be conveyed to the foot.

In another aspect of the present invention, the article of footwear further includes a foot bootie system for holding the foot of a wearer. The foot bootie system includes vent openings for providing air to ventilate the foot of a wearer. Further the foot bootie system is combined with a plurality of straps for securing the foot to the sole of the shoe.

In another aspect of the present invention, an article of footwear includes a tented shroud including a shroud and a frame member attached to the sole. The tented shroud covers the entire foot or a forefoot portion. In another aspect of the present invention, an upper has a flexible sheet of material that is interconnected with a plurality of frame members for tenting the flexible sheet of material.

In another aspect of the present invention, an article of footwear includes a sole and a shroud for covering a foot of a wearer. A foot holding system extends outwardly from the sole for holding the foot of the wearer to the sole. A frame member is provided for urging the shroud away from the foot of the wearer and the frame member includes a medial end and a lateral end coupled to the foot holding system.

In another aspect of the present invention, an article of footwear including a sole having a midsole. A shroud is provided for covering a forefoot portion and at least a midfoot portion of a foot of a wearer. A frame member is provided for tensioning the shroud away from the forefoot portion and at least a midfoot portion of the foot of the wearer. The frame member is attached to the midsole. A foot holding system is provided for holding the foot of the wearer to the sole.

In another aspect of the present invention, an article of footwear includes a sole having a midsole. The midsole includes a midsole periphery with a surface. A shroud system is provided for covering a foot of a wearer and the shroud system is attachable to the midsole periphery. A frame member is provided for tenting the shroud system from the foot of the wearer. A foot holding system is provided for holding the foot of the wearer to the sole.

In another aspect of the present invention, an upper system for an article of footwear, includes a shroud for covering at least a forefoot portion and a midfoot portion of a foot of a wearer. The shroud is removably coupleable to the article of footwear. A frame member is provided for tenting the shroud from at least the forefoot portion and the midfoot portion of the foot of the wearer. The frame member has a lateral end and a medial end coupled to a lateral side and a medial side of the shroud. In a further aspect, the shroud includes a locating member provided for removably coupling the shroud to the article of footwear and the locating member is disposed on a bottom periphery of the shroud.

It is an object of the present invention to provide a shoe that achieves support for a user's foot with a maximum amount of flexibility and breatheability with minimum weight. It is a further object of the invention to minimize the amount of the upper contacting the foot of a wearer. Yet another object of the invention is to provide a structure to ventilate the foot of a wearer.

The above and other objects, features and advantages of the present invention will be readily apparent and fully understood from the following detailed description of preferred embodiments, taken in connection with the appended drawings.

DETAILED DESCRIPTION OF THE PREFERRED EMBODIMENTS

Figure 1:
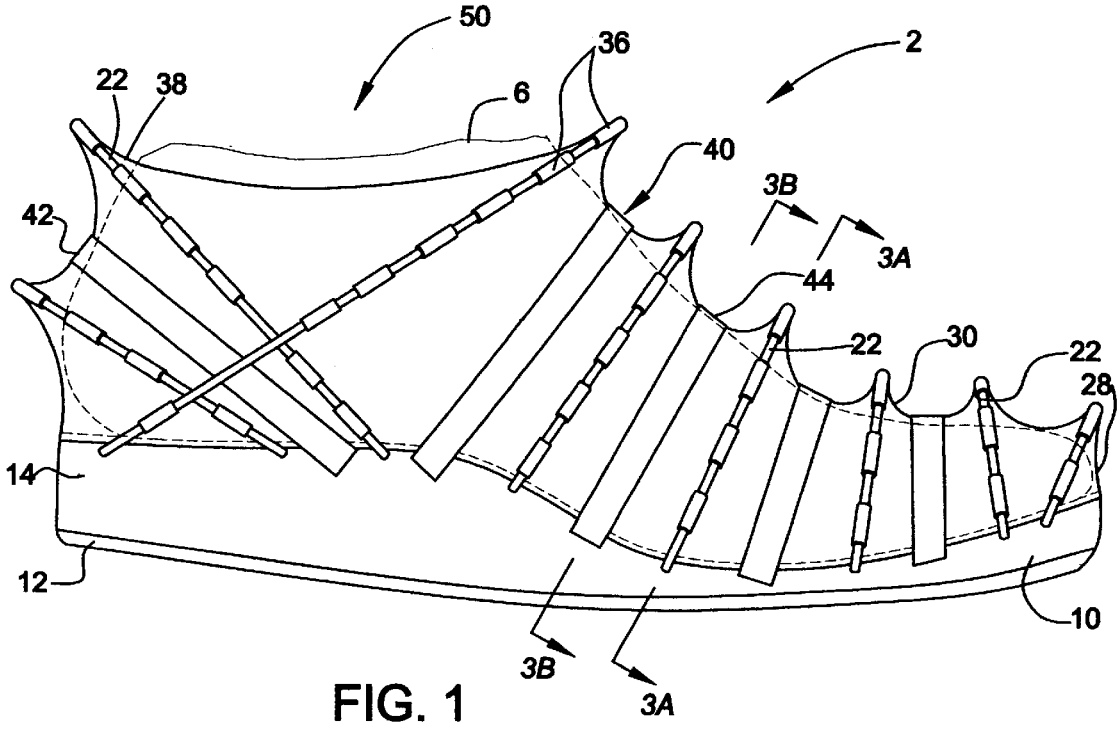
FIG. 1 is a side elevational view of the lateral side of an article of footwear of the present invention.

With reference to FIGS. 1–8, an article of footwear, for example an athletic shoe, in accordance with the present invention is illustrated. The article of footwear is generally referred to herein as a shoe and designated as numeral 2. The shoe 2 includes a sole 10 and an upper 30. The upper 30 has a foot engaging system 40 and a tented or tent-like structure to protect the foot and provide enhanced breathability. It should be noted that the terms "tented" or "tent-like" are defined herein as a structure having a layer of material or outer covering that is stretched or otherwise connected to a supporting framework of elements so as to form a substantially enclosing structure. Further the term "tenting" is defined herein as creating a tented or tent-like structure.

The shoe 2 has a medial side 16 and a lateral side 18. When the shoe 2 is worn the lateral side 18 generally faces away from the center line of a user's body. Likewise, the medial side 16 generally faces inward towards the centerline of a user's body. The sole 10 may further include an outsole 12 and a midsole 14. The outsole 12 provides a lower ground engaging surface designed for traction and typically made of a tough rubber material for wear resistance. The midsole 14 provides cushioning and support and is more compressible than outsole 12 to achieve its cushioning function. Any conventional sole design may be used provided that it has sufficient support and traction for the foot of the wearer for the desired activity or sport to be performed.

Figure 3A:
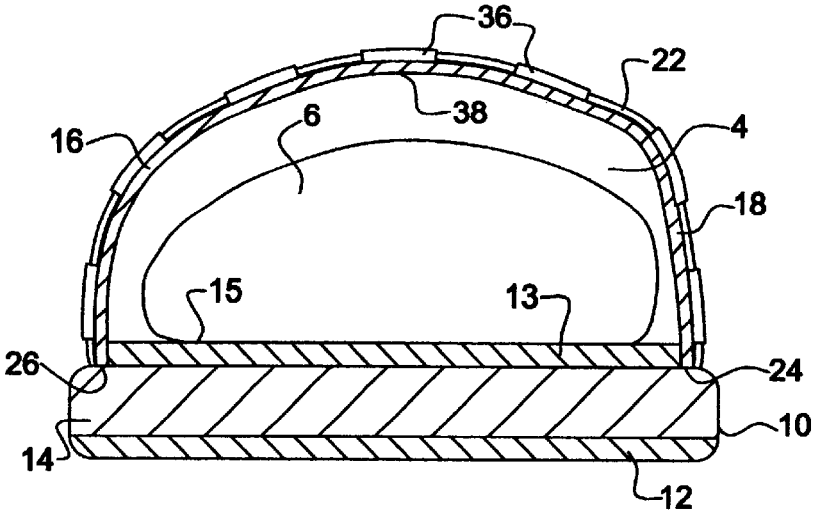
FIG. 3A is a cross-section taken through line 3A—3A of FIG. 1.
Figure 3B:
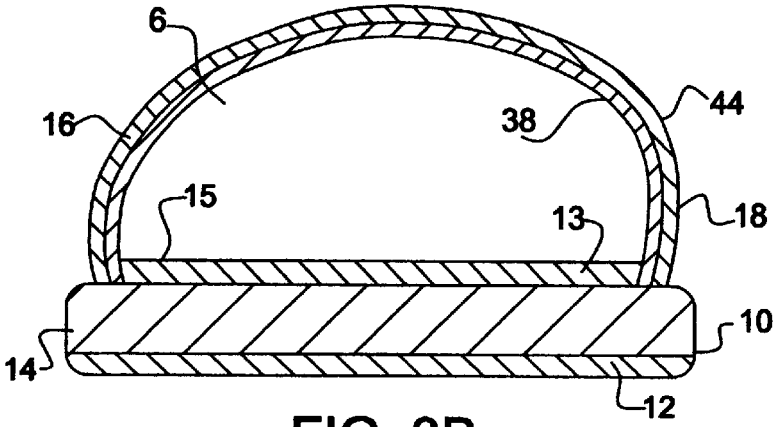
FIG. 3B is a cross-section taken through line 3B—3B of FIG. 1.

As shown in FIGS. 3A and 3B, the shoe 2 may include an insole or sockliner 13 disposed inside of the shoe 2 and is preferably positioned between the foot 6 of the wearer and the sole 10. In addition, the sockliner 13 further includes an upper surface defining a footbed 15, that is the portion of the shoe 2 that is in contact with the bottom of the foot 6 of the wearer. The sockliner 13 provides additional cushioning and shock absorption of the shoe 2. If desired, the sockliner 13 may be removable and replaceable for the shoe 2.

Figure 4:
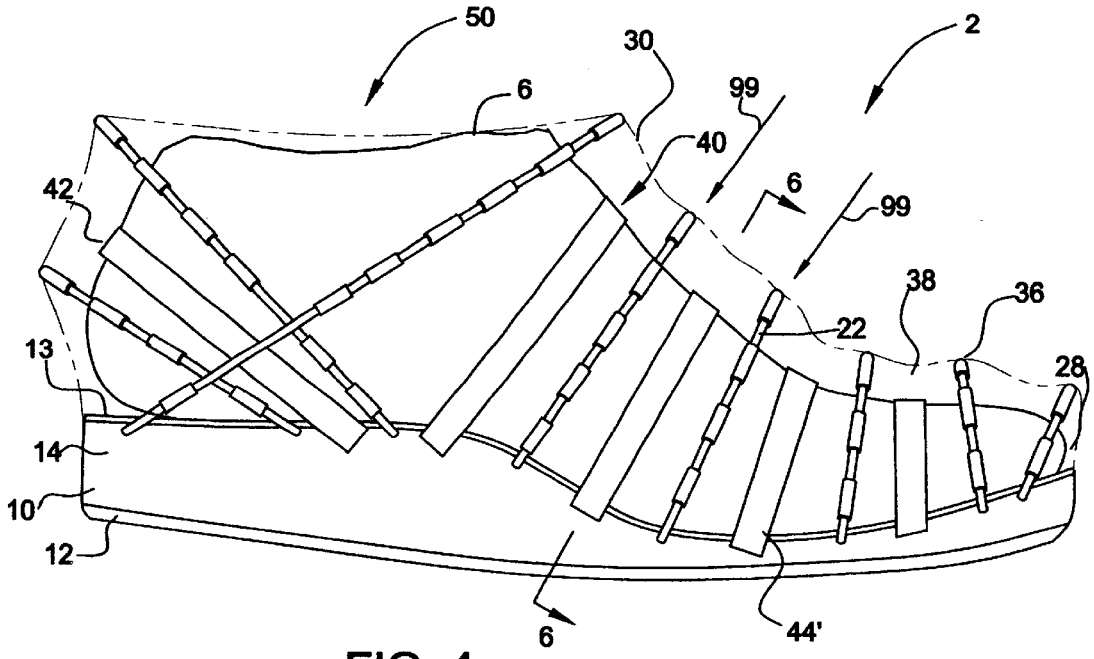
FIG. 4 is a schematic side elevational view of an alternate embodiment of an article of footwear of the present invention.
Figure 7:
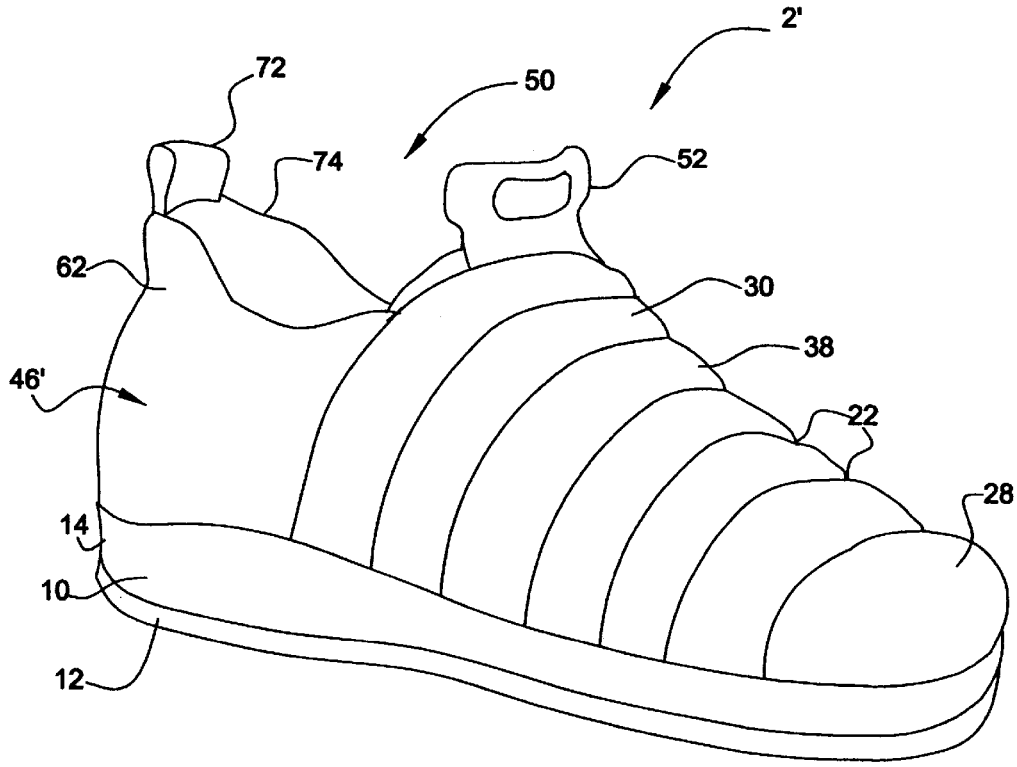
FIG. 7 is an isometric view of an article footwear according to another alternative embodiment of the present invention where the shroud substantially encloses the forefoot portion of the shoe.

The shoe 2 further includes the foot engaging system 40. The foot engaging system 40 serves to hold or secure the foot 6 of a wearer to the shoe 2, in particular, to the footbed 15 and the sole 10. A foot opening 50 enables a user to insert his or her foot 6 through the shroud 38 and into the shoe 2. The foot engaging system 40 may be disposed on the top of the shroud 38 as shown in FIG. 1 or may be disposed below the shroud 38 as shown in FIGS. 4 and 7.

The upper 30 includes an outer covering or a shroud 38 and supporting framework of a plurality of biasing or frame members 22 forming the tented or tent-like arrangement of the shoe 2. The shroud 38 functions to conceal and to provide breathability for the foot 6 of a wearer within the shoe 2. Additionally, the shroud 38 protects, and screens the foot 6 within the shoe 2 from debris. The frame members 22 are connected to the shroud 38 so as to influence or otherwise keep at least a portion of the shroud 38 away from the foot 6 of the wearer. The upper 30 similarly includes a medial side 32 and a lateral side 34. The shroud 38 may be secured to the sole 10 in any conventional manner, e.g., by stitching and/or gluing to the top surface of sole 10. Although the shroud 38 is preferably attached to the sole 10 on the medial side 16 and the lateral side 18, the shroud 38 may be removably attached from the sole 10 and to the frame members 22. Toe box 28 may include a wear resistant material, such as a plastic or rubber, located on the exterior or interior of the front portion of the shroud 38 for extending the life of the shoe 2.

With reference to the embodiments shown in FIGS. 1–6, the shroud 38 extends from the lateral side 18 to the medial side 16 of the sole 10 and extends from the toe box 28 to the heel of the user including the entire foot 6 of the wearer, including the rearfoot region. Shroud 38 may be attached directly to sole 10 comprising most of the external surface of upper 30. With reference to the embodiment shown in FIGS. 7 and 8, the shroud 38, however can cover just the forefoot region and toe box 28 for the foot 6.

Referring to the embodiments shown in FIGS. 1–8, the upper 30 further includes a plurality of frame members 22 extending from the medial side 16 to the lateral side 18 of the shoe 2. The frame members 22 contact the shroud 38 to form the tent-like structure of the shoe 2. The frame members 22 are preferably constructed and arranged with a resilient bias such that the shroud 38 is urged or influenced away from the foot 6 of a user. The urging feature of the frame members 22 pushes the shroud 38 outward. This substantially keeps the shroud 38 from contacting the foot 6 in at least the regions adjacent to frame members 22 and keeps the foot 6 or a portion of the foot 6 enclosed in the tent-like arrangement of the shoe 2. If desired, some frame members, not shown, may run in the longitudinal direction along the medial side 32 or lateral side 34 of the upper 30. That is the longitudinal direction running from the toe box 28 to the rear heel portion of the shoe 2. These additional frame members could join adjacent frame members 22 running between the lateral 18 and medial 16 sides.

The frame members 22 are preferably attached to the sole 10, in particular to the midsole 14 of the shoe 2. The method of attaching of the frame member 22 to the sole 10 may be of any desirable method, such as bonding with adhesive, molded in situ, or a mechanical fastening technique. In one arrangement, the midsole 14 includes a plurality of depressions formed to mate with the lateral ends 24 and medial ends 26 of the frame members 22. In yet another arrangement, the frame members 22 may be removable such that different rods of various elasticity properties, weights or sizes may be selectively changed by the wearer. This is advantageous for wearer options depending on the sport of intended use.

The frame members 22 are preferably elongated rods of any desired cross section, such as circular, square, rectangular, or triangular. The frame members 22 are preferably non-conductive, and resilient in that they easily and quickly recover to a desired shape after being bent or otherwise deformed. The frame members 22 are preferably constructed from any suitable flexible plastic material, such as nylon, HYTREL, ABS, Styrene or an elastomeric material, or if desired of a metal. The frame members 22 may also be formed with other suitable resilient materials, such as polymer composite materials, or fiber reinforced plastics. If desired, the frame members 22 may have an elongated thin planar feature formed out of plastic for providing increased force to bias the shroud 38. As assembled, each frame member 22 has a "tenting resistance" which is defined as the resistance against deflection at its center point when deflected in the plane of the member 22, such as shown by arrows 99 in FIG. 4. This may be determined by using an Instron machine to apply a force of the center of the frame member 22 in the plane of the frame member 22. The machine can deflect the frame member 22 by 10 mm and the force per distance deflected is measured. In a preferred embodiment, the tenting resistances of the frame members 22 are in the range between 0.2–2.5 Newtons per millimeter, and more preferably in the range between 0.3–1.0 Newtons per millimeter. In one preferred arrangement, the tenting resistance of at least some of the frame members 22 is approximately 0.5 Newtons per millimeter.

Figure 2:
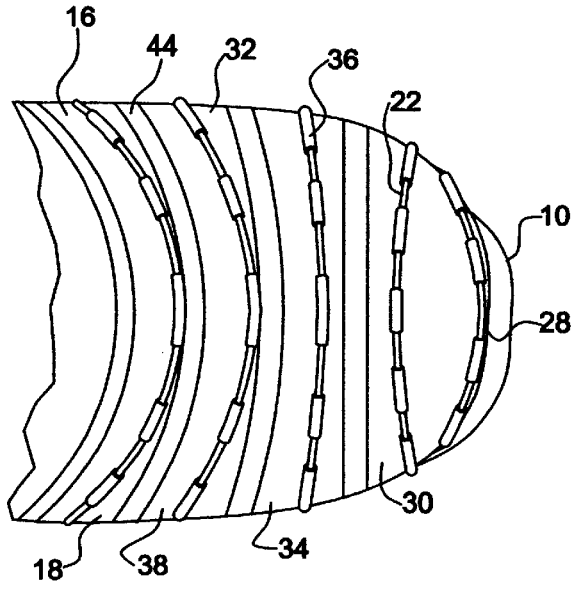
FIG. 2 is a top plan view of the forefoot region of the article of footwear shown in FIG. 1.

To provide the shoe 2 with the tented and tent-like structure and shoe shape, the frame members 22 may be threaded through a channel to urge or bias the shroud 38 off the foot 6. The frame members 22 are interconnected to the shroud 38 by a coupling system such as loops or sleeves, retained with the shroud 38 or by an adhesive. The plurality of spaced loops 36 may be disposed on the exterior or interior surface of the shroud 38. As shown in FIGS. 1 and 2, each individual frame member 22 is connected to the shroud 38 by the spaced loops 36. The loops 36 are in substantial alignment to form a pathway or channel for a frame member 22 so as to provide insertion of the members 22 through the loops 36 for connection to the medial 16 and lateral side 18 of the shoe 2. The loops 36 may be constructed of plastic or the material of the shroud 38. The loops 36 in plastic may be glued or otherwise bonded to the shroud 38. Likewise, if the loops 36 are formed with the material of the shroud 38, they may be sewn, stitched, or otherwise fastened to the shroud 38. Additionally, the coupling system may embody a plurality of sleeves (not shown) arranged in a similar alignment as the loops 36. In the sleeve arrangement, the sleeves may be constructed of the same material as the shroud 38.

In the loop or sleeve embodiment for the coupling system, the shroud 38 may move relative to the frame members 22 along the longitudinal axis of an individual frame member 22. This movement provides for greater flexibility of the upper 30 such that the shroud 38 will remain generally taut when the frame members 22 are bent or deformed. The coupling system may use an adhesive bond between the surface of the shroud 38 and the exterior surface of a frame member 22.

With reference to the embodiments shown in FIGS. 1–3, the shoe 2 further includes a foot engaging or holding system 40 that retains the foot 6 of the user. In particular, the foot engaging system 40 tightly holds the foot 6 of a wearer to the footbed 15 and sole 10. The foot engaging system 40 includes a plurality of strap members 44 for tightening and securing the foot 6. The strap members 44 are disposed on the external surface of the shroud 38 in the forefoot region and the rearfoot region of the shoe 2. This forms an exo-skeleton or skeletal type structure of narrow bands of the shoe 2 to hold the foot 6 to the sole 10. These strap members 44 minimize the amount the shoe 2 contacting the foot 6 to allow it to breathe within the upper 30. Each individual strap member 44 extends from the medial side 16 to the lateral side 18 of the shoe 2. Strap members 44 are fixedly attached to the sole 10 by any conventional manner, such as adhesive bonding, or stitching.

Referring to the forefoot region of the shoe 2, each strap member 44 is interposed between adjacent frame member 22 or at least one pair of frame members 22. This interposition facilitates the reliable connection of the foot 6 to the sole 10. The preferred quantity of strap members 44 may vary between two and five. As shown in FIG. 1, the shoe 2 includes four strap members 44 in the forefoot section and a heel locking strap 42 in the rearfoot region.

The heel locking strap 42 engages the Archilles heel portion of the foot 6 so as to secure and hold the heel to the footbed 15 and sole 10. The heel locking strap 42 is also interposed preferably between the two frame members 22 located at the heel region of the rear of the upper 30.

Referring to FIGS. 1–3, in use, the untightened or loose strap members 44 allows air to circulate around the foot 6. When the strap members 44 are tightened, small portions of the shroud 38 are pulled towards the foot 6. Minimal airflow is restricted within the upper 30 where the straps members 44 and shroud 38 contact the top of the foot 6. Because the frame members 22 are still in tension and forcing the shroud 38 away from the foot 6, a plurality of triangular-shaped air gaps 4 are formed between the frame members 22 and the strap members 44. The air gaps 4 allows the tented or tent-like upper 30 to have air to flow into the interior of the shoe 2. As such, each air gap 4 forms a channel-like arrangement extending from the medial side 16 to the lateral side of the shoe 2 whose cross section is generally triangular.

The strap members 44 and the heel locking straps 42 are constructed so as to place gentle compression forces around the periphery of the foot 6 of a wearer. As such, the compression forces may be accomplished in the variety of arrangements. The strap members 44 may be embodied by narrow bands of material. In one arrangement, the individual strap members 44 and the heel locking strap 42 may be formed with a single elastic material that stretches. In another arrangement, the strap members 44 and heel locking strap 42 may be formed with an adjustability feature having a two piece hook and loop system, similar to VELCRO® fastening system. In yet another arrangement, the strap members 44 and heel locking strap 42 may be formed with a two-piece system having an adjustable buckle with holes in a receiving strap.

FIG. 3A illustrates a cross-section of the shoe 2 taken along lines 3A—3A of the embodiment of FIG. 1 extending through a frame member 22. The cross-sectional view shows the relative position of the foot 6 of the wearer in the shoe 2 at the frame member 22. The shroud 38 is forced or tensioned away from the foot 6 by the frame members 22. The air gap 4 is formed between the shroud 38 and the foot 6. The sockliner 13 is at the bottom of the foot 6 of the wearer and footbed 15 is disposed the same. The frame members 22 have the lateral ends 24 and medial ends 26 fastened into the sole 10.

FIG. 3B illustrates a cross-section of shoe 2 taken along line 3B—3B of the embodiment of FIG. 1. This shows the relative disposition of the foot 6 at the strap member 44. The strap member 44 pulls a portion of the shroud 38 to contact the foot 6. The sockliner 13 is disposed similarly as shown in FIG. 3A.

In the embodiments shown in FIGS. 1–6, the rearfoot portion of the shoe 2 has at least two frame members 22 extending rearward from the quarter to the heel area. As such, the frame members 22 at the rear are in a diagonal arrangement.

To assist in developing the tent-like arrangement of the shoe 2, the shroud 38 preferably behaves in an elastic manner to enable it to be stretched. This permits the shroud 38 to lengthen to so as to become taut between the frame members 22 and the medial side 16 and lateral side 18 of the upper 30. To accomplish this, shroud 38 is preferably made from a woven material. The desired elastic behavior may be accomplished by using woven elastic fibers. In a preferred embodiment, the shroud 38 includes woven synthetic elastic fibers chiefly made from polyurethane, e.g., spandex. More specifically, a preferred embodiment is made from LYCRA® or another spandex fiber. LYCRA® is a trademark of the DuPont Corporation for its brand of elastane fiber. Shroud 38 may also include other types of fibers to achieve desired characteristics. Accordingly, the woven material of shroud 38 may be comprised of solely spandex or LYCRA®, or combinations of spandex and/or LYCRA®, and other materials such as nylon and/or cotton.

Additionally, these materials may also be constructed of a range of weave and knit patterns to vary the direction and amount of the elasticity of the shroud 38. In a preferred embodiment, the material is woven to provide equal four-way stretch capabilities, meaning that it stretches equally along all four planar axes. However, if desired, the woven elastic material may be formed so that it stretches more in one direction than another, such as allowing the material to stretch more or less in the vertical direction than the longitudinal direction. That is, it can stretch more or less in the direction from the ball of the foot 6 to the top of the foot, than the direction from the toe to the heel.

The material allows for breathability of the foot 6 so as to provide air to flow and penetrate the shroud 38 thereby conveying air into the interior air gaps 4 of the upper 30 and releasing the air from the interior of the upper 30. This air flow advantageously cools the foot 6 within the shoe 2 by causing an evaporative effect so as to remove moisture residing on the surface of the foot. Additionally, the material of the shroud 38 may provide protection from ultraviolet radiation. If desired, the shroud 38 may be removable or interchangeable. This removability or interchangeability provides the manufacturer with options to supply the shroud 38 in different visual appearances, breathability ratings, elasticity rating, or textures.

Also the wearer is provided with a selective adjustable shroud 38. For example, a wearer may desire a tented shoe 2 having a high breathable rating for extremely hot weather, but the wearer has a shroud 38 that is rated for cooler weather. The wearer can replace the cooler weather shroud 38 with an extreme hot weather shroud 38. This interchangeable feature may be accomplished in numerous ways. One such way may be to use mechanical fasteners on the medial side 32 and the lateral side 34 of the upper 30 that is removably connected into the medial side 16 and lateral side 18 of the sole 10. The mechanical fasteners may be conventional snaps having a male part mating with a female receiving part.

Figure 6:
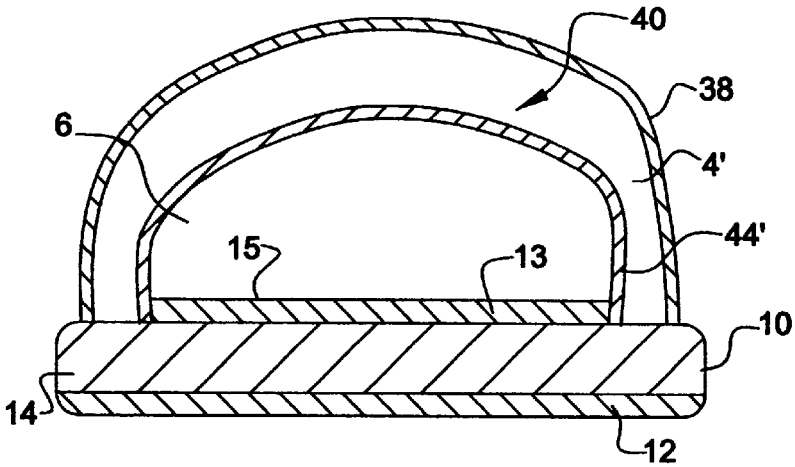
FIG. 6 is a vertical cross-sectional view taken through line 6—6 of FIG. 4.
Figure 5:
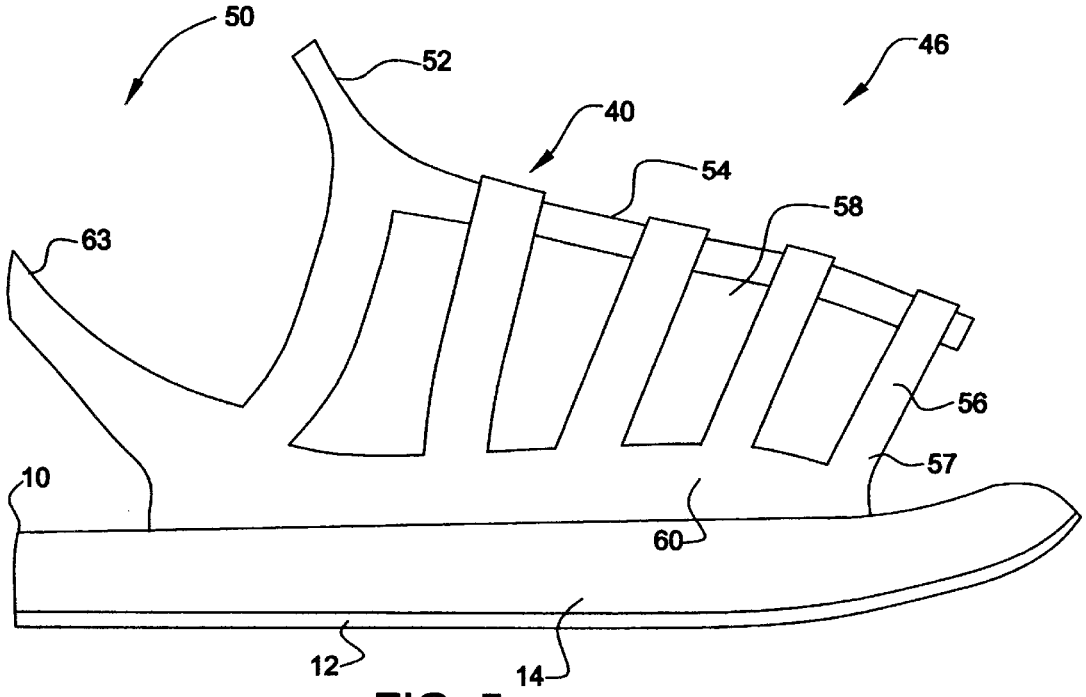
FIG. 5 is a side elevational view of the article of footwear of FIG. 4 with the shroud and frame members removed to reveal one embodiment of a foot engaging system of the present invention.

FIGS. 4–6 illustrate a schematic embodiment of the present invention having the foot engaging system 40 enclosed within the shroud 38. This embodiment is similar to the embodiment shown in FIG. 1 except that the foot engaging system 40, such as strap members 44' are disposed inside the shroud 38. The strap members 44' may be discrete elements of predetermined length for retaining the foot 6. For example, the strap members 44' may be formed of elastic bands that act to hold the foot 6 and the sole 10 together. The foot 6 of the wearer is enclosed so that the tented or tent-like structure provides protection and substantial air ventilation to the foot 6.

FIG. 5 illustrates another arrangement of the foot engaging system 40 useable with the shoe of FIG. 4 embodying an inner stretchable foot holding frame or an inner bootie system 46. The inner bootie system 46 is generally a unitary body in which the forefoot portion includes a skeletal like structure of narrow bands 54 and 56 to hold the foot 6. In one arrangement, the skeletal structure includes a longitudinal top band 54, transverse strap elements 56. The strap elements 56 substantially extend from the medial side 16 to the lateral side 18 of the shoe 2. The lower opposing ends 57 of the strap elements 56 are attached to a respective lower strap element 60. The lower strap element 60 is a narrow band of material disposed around the outer periphery of at least the side of the sole 10. Each lower strap element 60 connects the inner bootie system 46 to the sole 10 of the shoe 2 on either the medial side 16 and lateral side 18. The lower strap element 60 is fastened to the sole 10 in any conventional manner such as stitching, or gluing, or other well-known fastening techniques. The longitudinal top band 54 engages the top portion of the foot 6.

The inner bootie system further includes a plurality of holes or air vents 58. The vents 58 are large openings within the inner bootie 46 that allows air to flow and contact the surface the foot 6 of the wearer so as to ventilate the foot 6. The vents 58 are interposed between the strap elements 56 in which the vents 58 have an outer periphery formed of the strap elements 56, the longitudinal top band 54, and the lower strap element 60.

The rear of the inner bootie system 46 includes a heel strap 63. The heel strap 63 wraps around the Achilles portion of the heel of the foot 6 extending from the medial side 16 and the lateral side 18. The rear of the inner bootie system 46 further includes a foot opening 50 to receive the foot 6 of the wearer. Optionally, a front pull tab 52 may be provided. The front pull tab 52 is connected to the rear of the longitudinal top band 54. If desired, the heel strap 63 may be replaced an enclosed heel portion (not shown) extending from the top of the sole 10 and counter (not shown) to provide extra support for the foot.

The inner bootie system 46 components may be constructed from narrow bands of lightweight resilient material. The purpose of using the material is to provide the foot engaging system 40 with gentle compression forces to secure the foot 6 to the sole 10. In one arrangement, the material may be a single layer of a woven open mesh material. A material for accomplishing this may include a permeable synthetic mesh material formed from a nylon or polyester double needle bar rachel construction, such as a spacer mesh. One manufacturer of such a material is Dae Woo of Korea. In another arrangement, the material may be formed of multiple layers, such as a three layer sandwich arrangement having an exterior layer, a middle layer, and an interior layer. The exterior layer may be a woven open mesh material as described above. The middle layer may include an open cell foam material, such as polyurethane or latex, typically used in shoe construction. The interior layer may be an inner lining material. The middle cushioning layer is preferably used in the heel region. Another feasible material is a synthetic material of plastic having a weave pattern that lengthens along its longitudinal axis but shortens in the transverse direction to its longitudinal axis when the material is stretched. This may be used alone or in combination with the arrangements described above and shown in FIGS. 9–19. The materials used for bands of material preferably have breathability and allow moisture to dissipate therethrough.

If desired, the inner bootie system 46 may have added fastening capability. The strap members 44 such as shown in FIG. 1 or 4 may be aligned with the strap elements 56. The lower ends of the strap members 44 are attached to the sole 10 of the shoe 2 and if desired, a middle portion of the strap members 44 may be connected to the longitudinal top band 54. This dual arrangement of the inner bootie system 46 and strap members 44 is advantageous to provide additional retaining force of the foot 6.

FIG. 6 is a cross-sectional view of the embodiment of FIG. 4 taken along line 6—6. An air gap 4' is formed between the shroud 38 and the foot 6. The frame members 22' are holding the shroud 38 away from the foot 6 in a similar manner as shown in FIG. 1. The strap members 44' or 56 engage the foot 6 of the wearer. The air gap 4' provide the wearer with substantial ventilation in which air travels through the shroud 38. It is appreciated that the air gap 4' extends around the entire upper periphery of the foot 6 located within the shroud 38. The protection function of the shroud 38 is separated from the holding function of the lightweight strap members 44' which are the main portions of the shoe 2 contacting the foot. Thus, the wearer is provided with a substantially barefoot arrangement in which the shoe acts like an extension of the foot 6 and is protected by the shroud 38.

Figure 8:
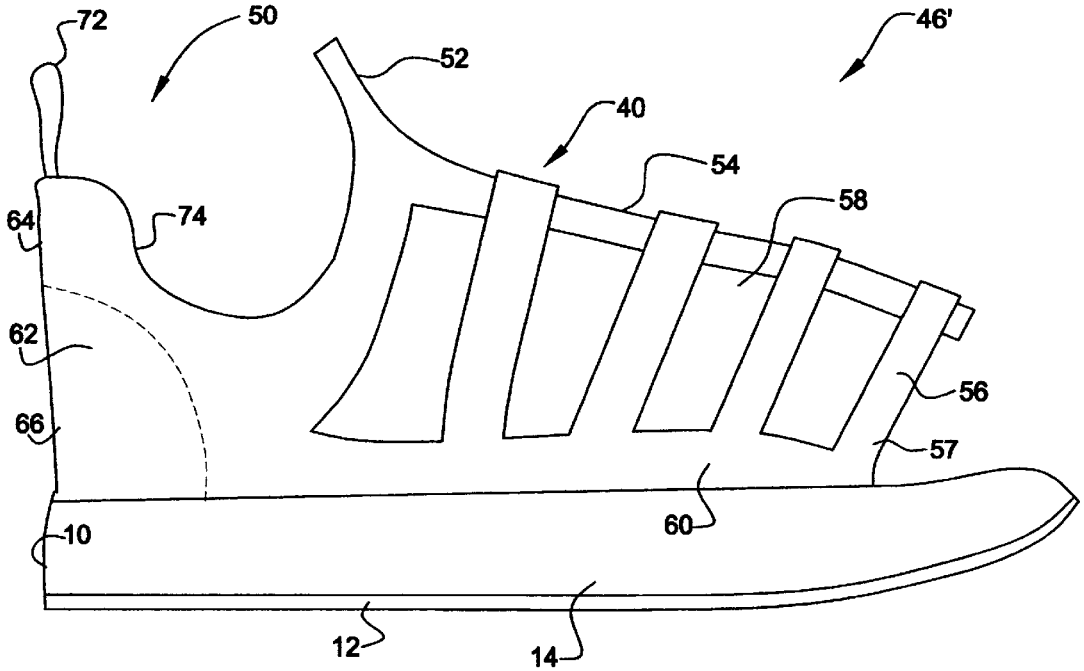
FIG. 8 is a side elevational view of the lateral side of an article of footwear of FIG. 7 revealing an alternative foot engaging system of the present invention.

With reference to FIGS. 7 and 8, a further embodiment of the present invention is shown. An article of footwear, such as a shoe 2', can include a foot bootie system 46' partially exposed due to a rearfoot section 62. This embodiment is similar to the embodiment shown in FIG. 4 except the shroud 38 covers the entire forefoot portion of the shoe 2' and not the rearfoot portion. The shoe 2' further includes a sole 10 having an outsole 12 and a midsole 14. The foot bootie system 46' is attached to the sole 10. The shoe 2 includes a shroud 38 with frame members 22 covering the forefoot region of the foot, i.e. partially covering the foot 6 of the wearer. The forefoot region of the bootie system 46' is located within the interior of the tented or tent-like structure created by the shroud 38 and frame members 22. FIG. 7 shows the frame members 22 disposed interior of the shroud 38 and coupled to the shroud 38 by adhesive bonding. Thus, the exterior surface of the shroud 38 may have ridges formed by the frame members 22 pushing the shroud 38 outward. It is noted that the frame members 22 may alternatively be coupled to the shroud 38 by other methods such as spaced loops 36 located on the interior or exterior of the shoe 2' as shown in the embodiment of FIGS. 1 and 4.

Similarly, as with the other embodiments, the embodiment of shoe 2' and the frame members 22 forces the shroud 38 away from the foot 6 of the wearer, thus forming the tent-like structure protecting the foot 6 from debris and other objects that may injure the foot 6. Referring to FIG. 8, the foot bootie system 46' is similar to the embodiment of the foot engaging system 40 shown in FIG. 5. The forefoot portion of the bootie 46' includes a structure of material similar to inner bootie 46. The rearfoot portion of bootie 46' is similar to inner bootie 46, except heel strap 42 has been eliminated. The bootie 46' has a similar function to ventilate the foot 6 or inner bootie 46 cooperation with the shroud 38 in the embodiment of FIG. 4.

Referring to the rearfoot portion of the foot bootie system 46', a rearfoot section 62 includes a heel section 64 and an ankle collar 74. The rearfoot section 62 includes the foot opening 50 to receive the foot 6 of the wearer. The rearfoot section 62 substantially encloses the rear of the foot. The enclosed heel section 64 wraps around the heel of the foot 6 extending from the medial side 16 and the lateral side 18. The ankle collar 74 is disposed at the top portion of the rearfoot section 62 and provides comfortable contact surface to the Achilles tendon area of the foot 6 of a wearer. Optionally, the rearfoot section 62 may include a rear pull tab 72. A front pull tab 52 may be provided at the front of opening 50. If desired, the heel section 64 can include a counter 66 to provide extra support for the foot.

The counter 66 is a stiffened portion of foot bootie system 46' disposed within the heel section 64, and is preferably made from plastic, or a similar material. The counter 66 extends upwardly from the top surface of sole 10 and includes a lower portion 68. The lower portion 68 is proximate to the top surface of sole 10 and further secures the base of a foot 6 by resisting medial and lateral motion of the foot 6 of the wearer. The counter 66 supports the heel and Achilles tendon area of the foot 6 of a wearer. The counter 66 may be varied in many ways to optimize support and minimize weight depending upon the type of activity. For instance, it may be beneficial for running shoes to include the additional stiffness provided by a counter to reduce pronation of the foot. If desired, the embodiment of FIGS. 1–3 can be modified so that the shroud 38 and foot engaging system 40 cover the forefoot region only, similar to the embodiment depicted in FIG. 7.

FIGS. 9–12 illustrate an alternative embodiment of the present invention. The terms forefoot section, midfoot section, and rearfoot section or the respective regions as used herein generally correspond to the locations of the forefoot, midfoot, and rearfoot of a wearer as would be understood by one of ordinary skill in the art.

Figure 9:
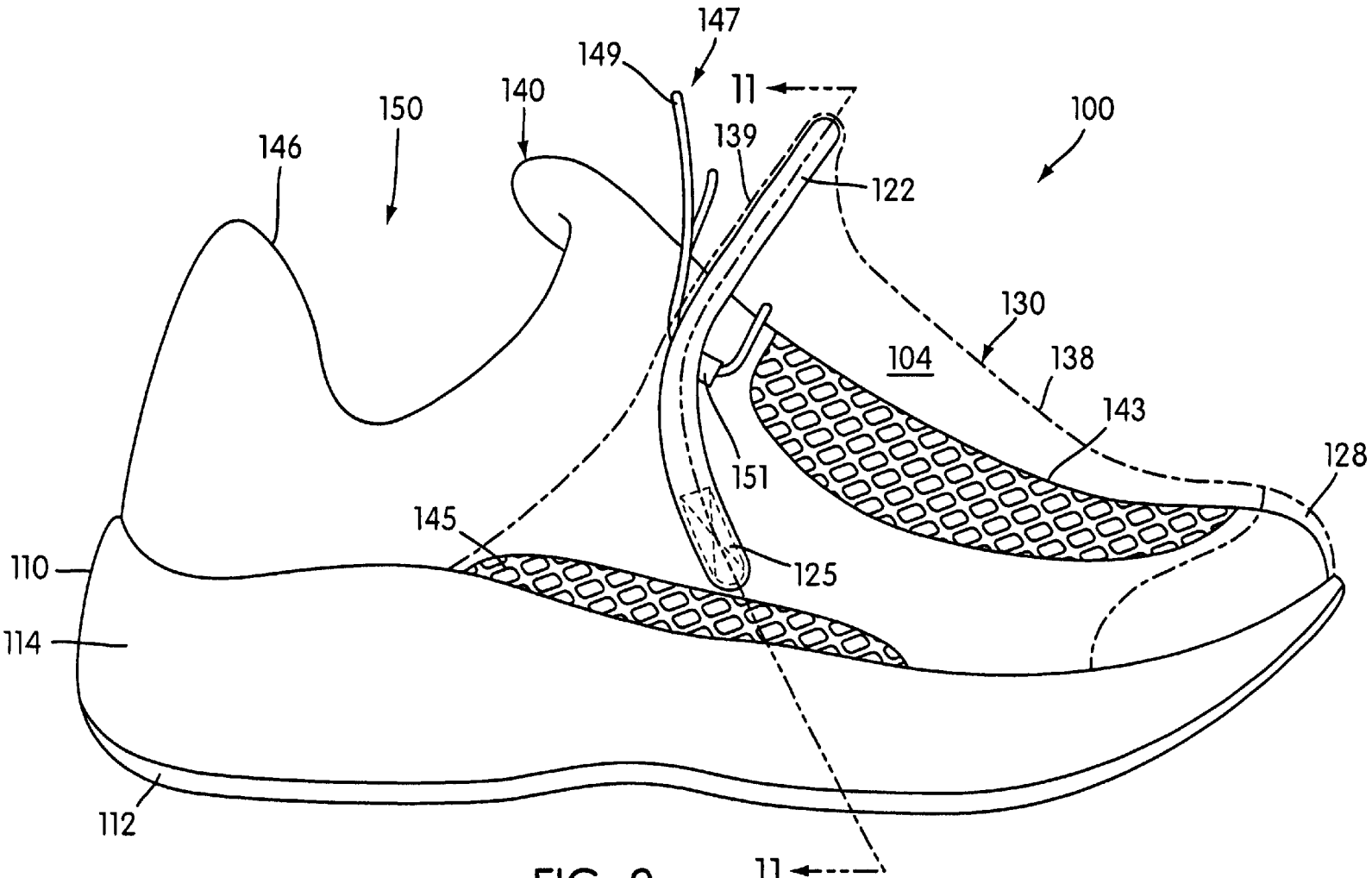
FIG. 9 is a schematic side elevational view of an alternative embodiment of an article of footwear with a biasing member attached to a foot bootie.

As with other disclosed embodiments, an article of footwear, such as a shoe 100, includes a foot engaging system or foot holding system 140 and an upper in a tented arrangement having a shroud 138. The foot engaging system 140 may include a foot bootie system 146 having a foot opening 150 for the foot of the wearer. As shown in FIG. 9, the forefoot region of the bootie system 146 is disposed within the interior (inside) of the enveloping biased structure created by shroud 138 and a single frame member 122.

Figure 12:
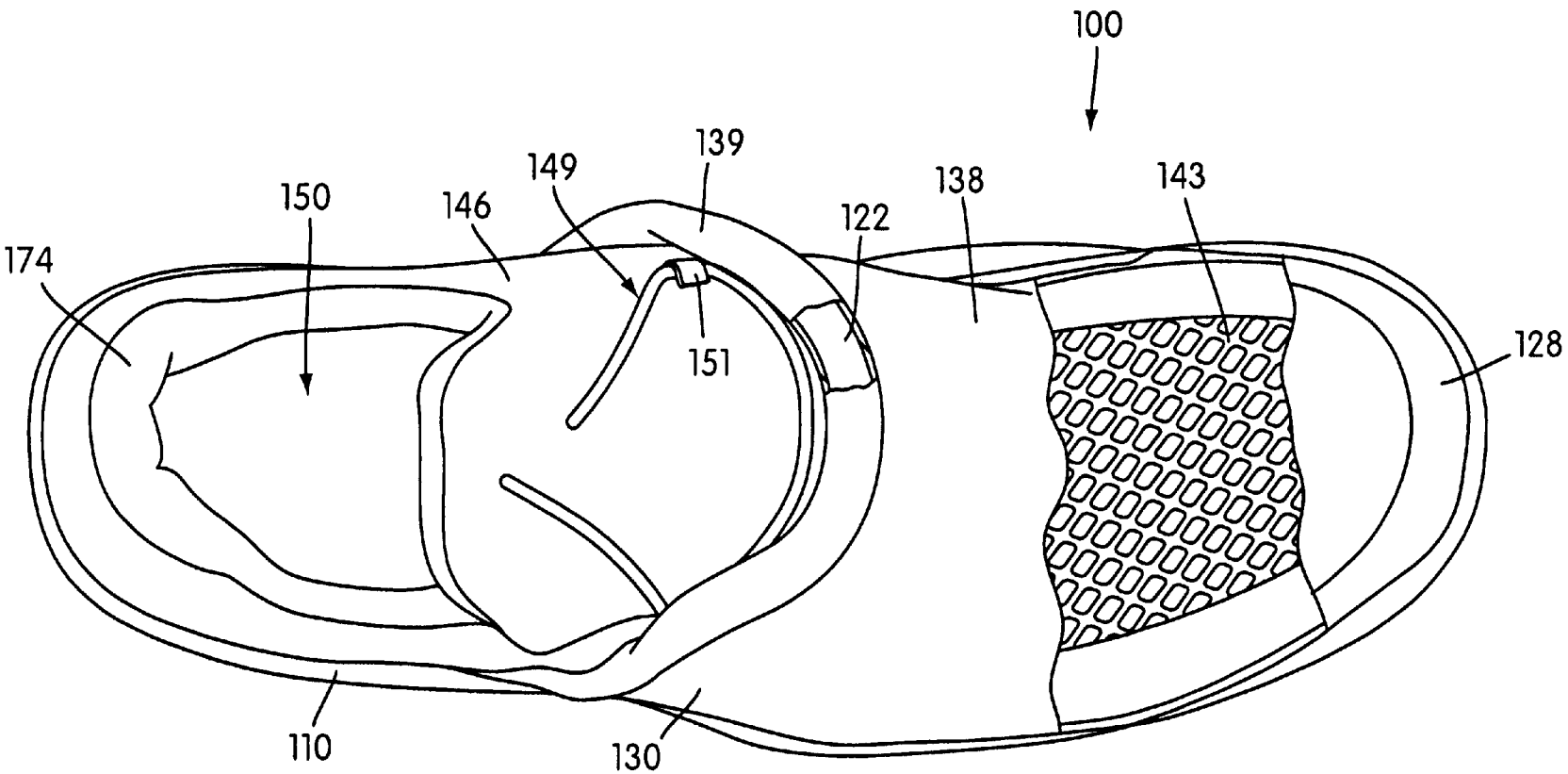
FIG. 12 is a schematic top plan view of the article of footwear of FIG. 9 with a portion of an upper removed to reveal a aeration region of a foot bootie and the biasing member in a sleeve arrangement.

In the embodiment, the shroud 138 covers a forefoot portion and a midfoot region in the arched portion of the shoe 100. The shoe 100 includes a sole 110 having a midsole 114 and an outsole 112 with similar construction and functions as the embodiments shown in FIGS. 1–8. If desired, shoe 100 may include more than one frame member. In one embodiment, foot bootie system 146 is generally a unitary body attached along its periphery to sole 110 by a desirable method, such as stitching or adhesive bonding. Foot bootie system 146 is preferably attached to the midsole 114 of sole 110. Foot bootie system 146 may also have an ankle collar 174 as shown in FIGS. 10 and 12.

Shoe 100 preferably includes a flexible shroud 138 attached to a frame member 122 traversing from the medial side 16 over the forefoot region to the lateral side 18 of the upper 130. The frame member 122 has a similar material composition and resiliency as the frame members 22 shown and described with reference to FIGS. 1–8. Frame member 122 is connected to the shroud 138 by a coupling system retained with the shroud 138, such as an elongated sleeve 139 sized to accept member 122. The frame member 122 is preferably routed through the interior of the sleeve.

In use, the frame member 122 urges or biases the shroud 138 off the foot bootie system 146, and in particular the foot of the wearer. As seen in FIGS. 9–11, this biasing arrangement generally forms an air gap 104 between the foot bootie system 146 and shroud 138. The air gap 104 is generally formed between the underside of shroud 138 and upper surface of foot bootie system 146. The sleeve 139 may be constructed in a number of arrangements. In one arrangement, the sleeve may be constructed of and from the same material as shroud 138. If desired, overlapping portions of the shroud 138 may be folded over and attached to form the sleeve 139.

Figure 10:
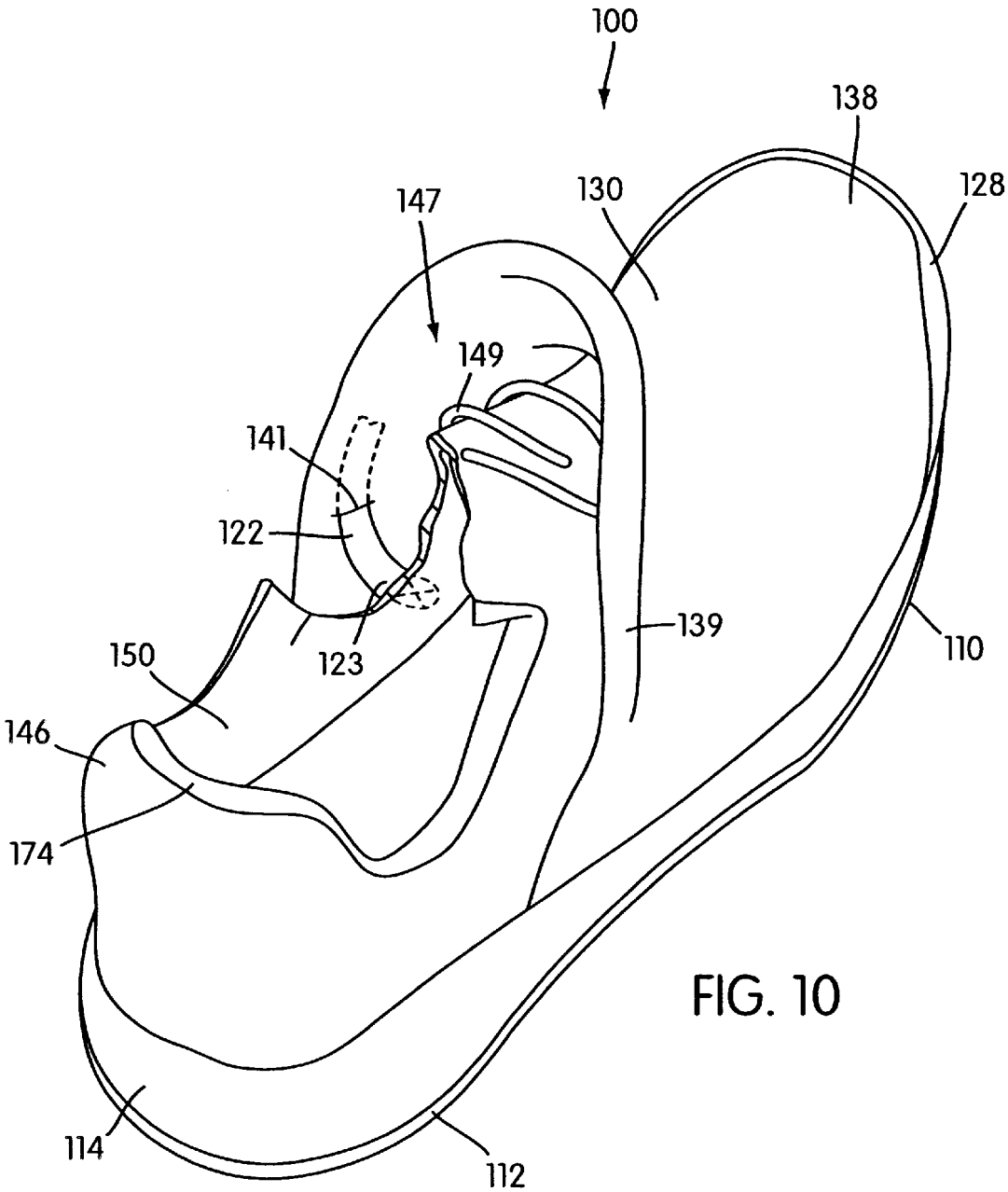
FIG. 10 is a schematic perspective view of the article of footwear of FIG. 9 with a portion of the foot bootie removed to reveal a portion of the biasing member.
Figure 11:
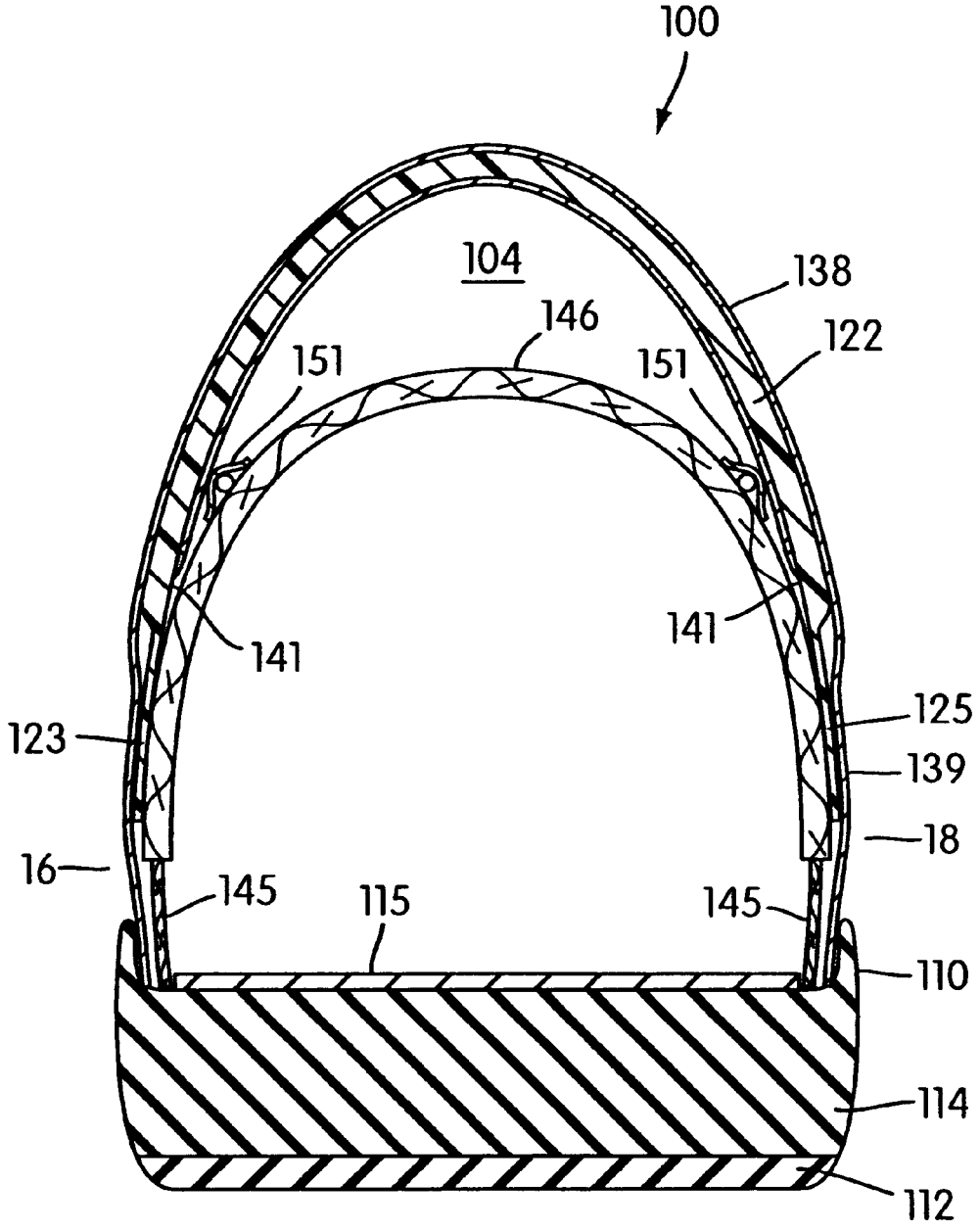
FIG. 11 is a cross-section view of the article of footwear of FIG. 9 taken along line 11—11 in FIG. 9.

FIG. 10 illustrates a schematic perspective view of the article of footwear with a portion of the foot bootie system removed to reveal a medial portion of the frame member 122 extending out from sleeve 139. In the illustrated embodiment, as seen in FIG. 11, the medial end 123 and lateral end 125 of the frame member 122 are preferably attached to the corresponding medial side 16 and lateral side 18 of the foot bootie system 146. To accomplish the attachment, the medial end 123 and lateral end 125 of the frame member 122 extends through corresponding opened or outlet portions 141 of the sleeve 139 on the medial side 16 and lateral side 18 thereof. As shown in FIGS. 9–10, frame member 122 may be attached to the surface of foot bootie 146 by a desirable method, such as bonding with adhesive or sewn into the material of the foot bootie system 146. This medial side-to-lateral side attachment to foot bootie system 146 advantageously maintains the tenting resistance of the frame member 122 and provides improved manufacturing efficiencies by generally fastening the bottom periphery of the shroud 138 and the foot bootie 146 to the sole 110 in fewer steps.

As shown in FIGS. 9 and 12, in a preferred construction, foot bootie system 146 may include a forefoot aeration region 143 and/or side aeration regions 145 which facilitate ambient air to flow and aerate the surface the foot of the wearer, at least in the regions. This action facilitates an evaporative effect so as to remove moisture residing on the surface of the foot. In a preferred construction, the forefoot aeration region 143 and side aeration regions 145 are constructed from an open mesh material such as previously described in the embodiment of FIG. 5. Nevertheless, other mesh materials may be implemented for the foot bootie system 146 to provide the aeration function. The material surrounding the aeration regions of the foot bootie system 146 can be constructed of a nylon material or other desirable materials that holds the foot. Forefoot aeration region 143 may include a generally large surface area of the forefoot portion of foot bootie system 146, approximately ranging from 50% to 70%, and preferably from 55% to 65%. Likewise, side aeration regions 145 may comprise 10% to 25%, and preferably 15% to 20% of the surface area of the forefoot portion of foot bootie system 146.

With continued reference to FIGS. 9 and 12, forefoot aeration region 143 is preferably disposed on the top of portion of the forefoot section to maximize the aeration function of ambient air being conveyed through the shroud 138 and/or air entering rearwardly through the air gap 104. Side aeration regions 145 of foot bootie system 146 may be disposed on the lateral side 18 and medial side 16 of shoe 100 in the forefoot region. As shown in FIG. 9, the rearward portion of shroud 138 covers the side aeration regions 145.

This arrangement keeps side aeration regions 145 inside of shroud 138 to provide cooling air, but not to overly expose the foot of the wearer to adverse ambient environments.

Foot bootie system 146 preferably includes an adjustable foot fastening system 147 to assist in tightly holding the foot of a wearer to the footbed 115 and sole 110. In the illustrated embodiment, foot fastening system 147 includes a conventional lace 149 which extends through loops 151 or eyelets (not shown) attached to the material of foot bootie system 146. In use, when the lace is pulled taut, the medial side 16 and lateral side 18 of foot bootie system 146 are forced towards each other to exert compression forces on the foot of the wearer. The lace may be tied at the top or alternatively fastened. If desired, shoe 100 may include a toe guard 128 constructed of a durable material, such as rubber, or a plastic. The toe guard 128 may be connected to the shroud by any desirable method, such as adhesive or chemical bonding or other conventional ways.

FIGS. 13–16C illustrate an alternative embodiment of the present invention. An article of footwear, such as a shoe 200, includes a foot engaging system or foot holding system 240 including a foot bootie system 246, and an upper 230 with a shroud 238 for covering a forefoot portion and a midfoot portion in arch region of a foot of a wearer. As with the other embodiments of the article of footwear, a frame member 222 urges or biases the shroud away from the foot bootie system 246 and in particular the foot of a wearer. Foot bootie system 246 includes a foot opening 250 which receives the foot of the wearer therein. The shoe 200 includes a sole 210 having a midsole 214 and an outsole 212. If desired, shoe 200 may include a toe guard 228.

Figure 13:
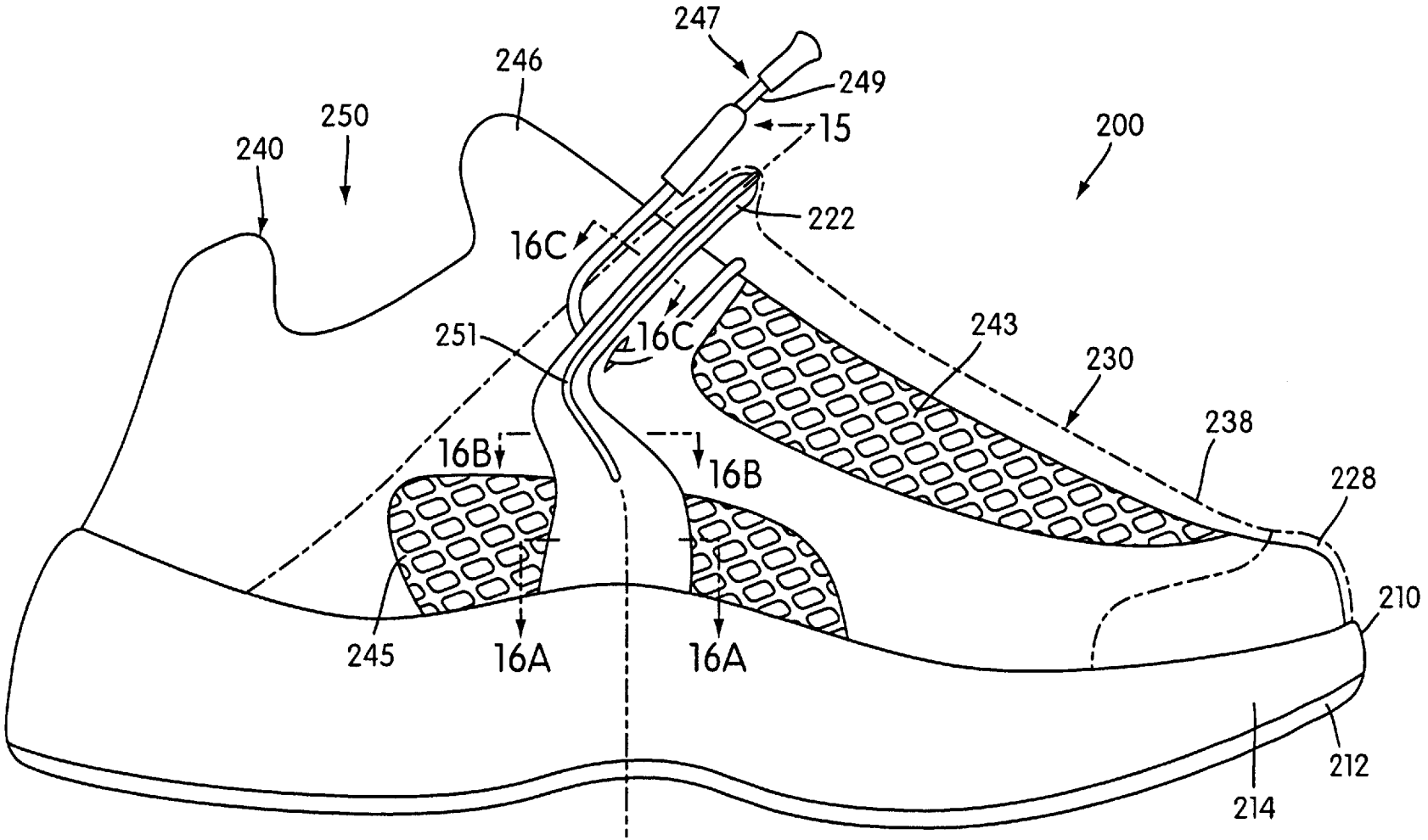
FIG. 13 is a schematic side elevational view of another alternative embodiment of an article of footwear with a biasing member attached to a midsole.
Figure 14:
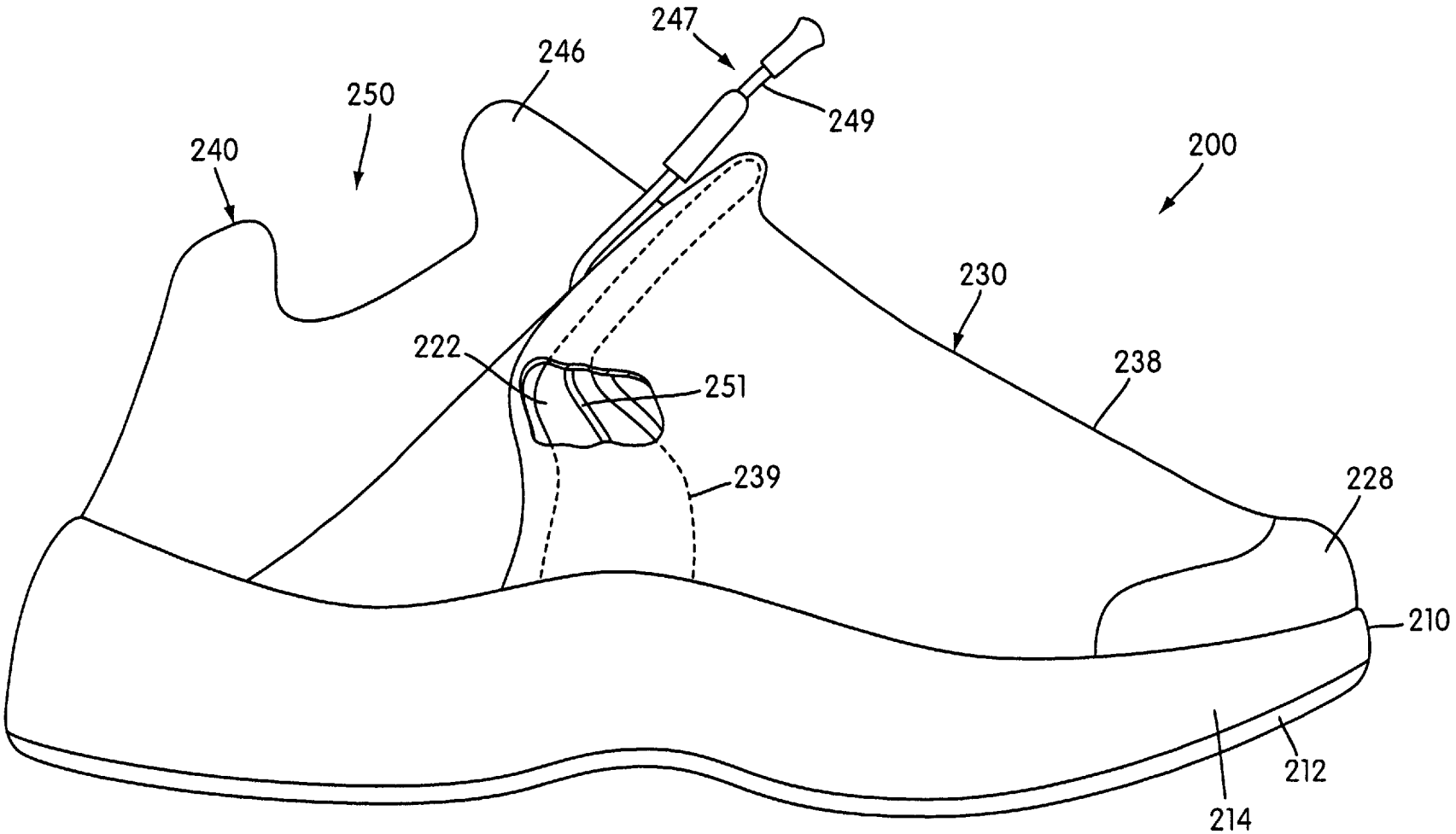
FIG. 14 is a schematic side elevational view of the article of footwear of FIG. 13 with a portion of the a sleeve of the upper removed to reveal a portion of the biasing member.

Similar to the embodiment shown in FIG. 9, shoe 200 includes an adjustable closed loop foot fastening system 247. The fastening system 247 of shoe 200 preferably includes a conventional closed loop tensioner 249. In use, when tightened, the tensioner 249 compresses the foot bootie 246 against the foot of the wearer to hold it against footbed 215. As shown in FIGS. 13 and 14, the tensioner 249 may extend rearwardly from the foot bootie 246 through an air space 204 formed between shroud 238 and foot bootie 246. Foot bootie system 246 may include a forefoot aeration portion 243 and side aeration portions 245 to facilitate aeration of the foot of a wearer by air in a similar manner as shoe 100. In this embodiment, side aeration portions 245 span between the forefoot portion and the midfoot portion of foot bootie system 246. Further, the side aeration portions 245 are disposed on the medial side 16 and lateral side 18 of foot bootie system 246. If desired, the forefoot aeration portion 243 and/or side aeration portions 245 can be eliminated from shoe 200.

As shown in phantom lines in FIG. 14, frame member 222 is connected to shroud 238 by an appropriately sized sleeve 239. In FIG. 14, a portion of the sleeve 239 has been removed to reveal the frame member 222 therein. Similarly as the embodiment of shoe 100, sleeve 239 can be formed by the material of the shroud 238. In the illustrated arrangement in FIGS. 13–15, sleeve 239 may be constructed by sections of the shroud material sewn together to form an elongated pocket to retain therein frame member 222. Nevertheless, sleeve 239 may be constructed of other ways as described in the embodiments shown in FIGS. 1–8.

Figure 15:
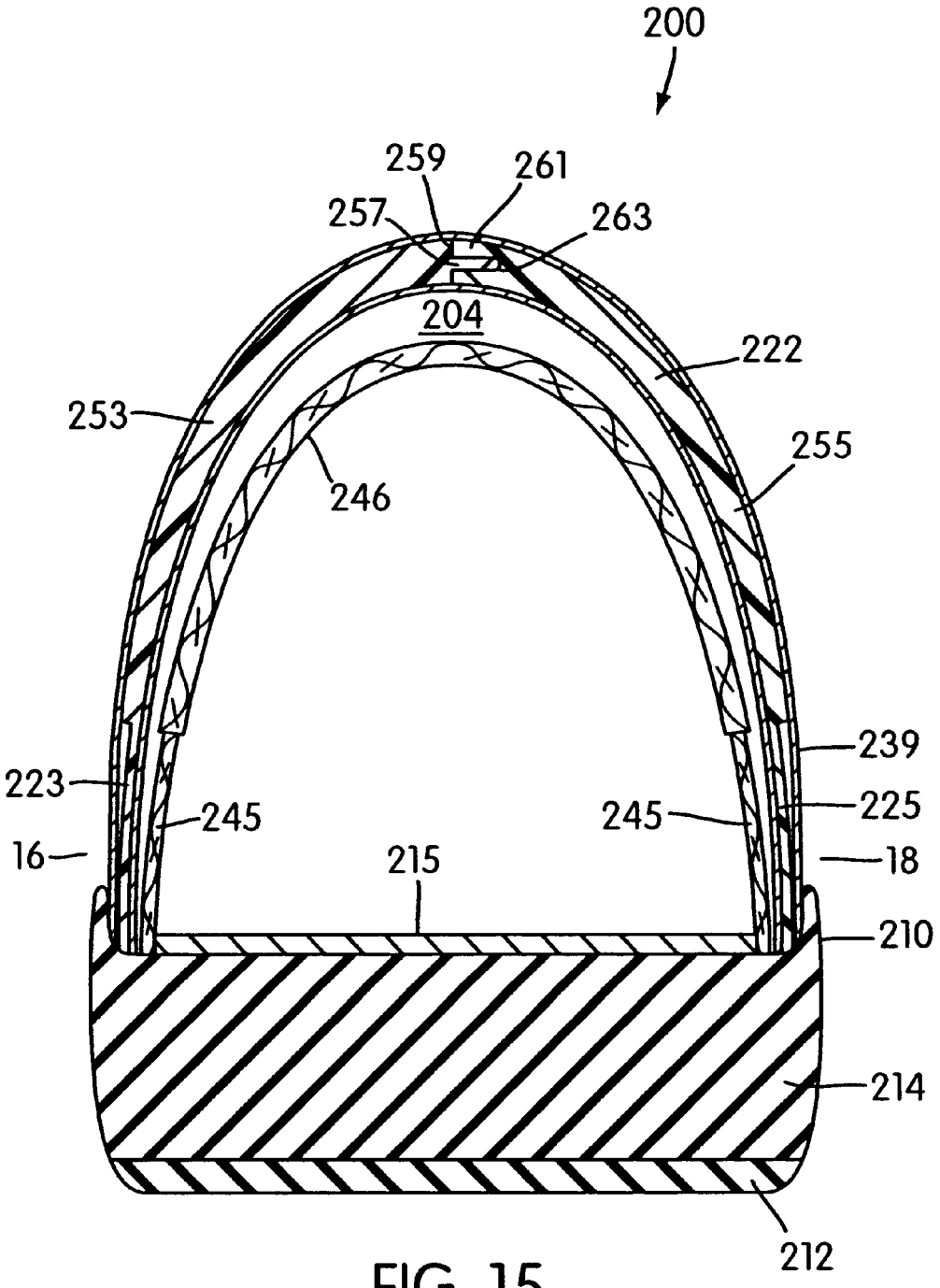
FIG. 15 is a cross-section view of the article of footwear of FIG. 13 taken along line 15—15.

Referring to FIG. 15, frame member 222 is coupled to the sole 210, and preferably to coupled to midsole 214. The medial end 223 and lateral end 225 of member 222 can be coupled to midsole 214 in a number of arrangements. In one arrangement, frame member 222 may be adhesively bonded to the midsole 214. In an alternative arrangement member 222 may be molded in the midsole 214.

FIG. 15 illustrates a cross-section view of the article of footwear shown in FIG. 13 taken along line 15—15. As seen in FIG. 15, frame member 222 may have a multi-part configuration formed with a medial portion 253 and lateral portion 255 interfitted or removably coupled together in a force fitting arrangement. The medial portion 253 includes a protrusion portion 257 extending from an engagement end 259. The protrusion 257 is preferably cylindrical as shown, but may be alterative shapes, such as prismatic, or cubic. Conversely, a corresponding engagement end 261 of lateral portion 255 includes complementary shaped receiving portion or depression 263 sufficiently sized to accept and interfit with protrusion 257 on medial portion 253. To create the engagement of the medial portion 253 and lateral portion 255, an upper area of protrusion 257 presses against a corresponding area of the receiving portion 263 on lateral portion 255 of frame member 222. In this arrangement, the engagement ends 259, 261 are restrained from moving towards each other. If desired, protrusion 257 and receiving portion 263 can be reversed on the lateral portion 255 and medial portion 253 to perform the coupling arrangement. In these arrangement, the multi-part configuration of frame member 222 assists in efficient manufacturing of the shoe 200.

Figure 16A:
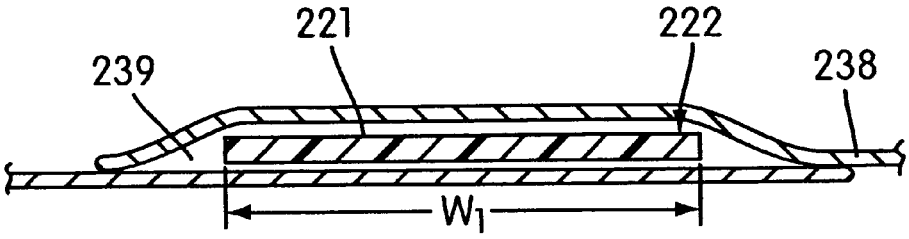
FIGS. 16A–16C are cross-section views of the biasing member and a sleeve arrangement of FIG. 13 taken along lines 16A—16A, 16B—16B, and 16C—16C, respectively.
Figure 16B:
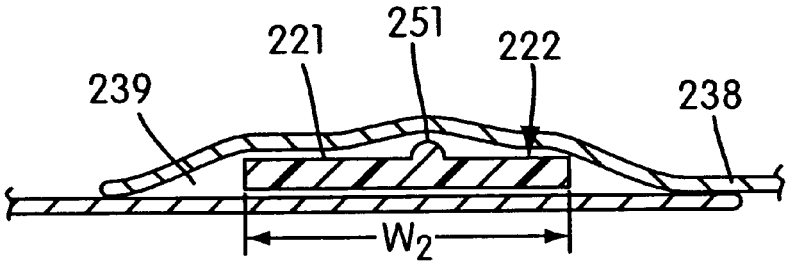
Figure 16C:
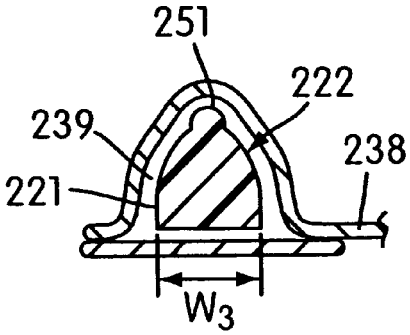

In one arrangement, frame member 222 may include a frame body 221 and a rib 251 (see FIGS. 16B and 16C). Rib 251 is attached to provide stiffness and enhanced tenting resistant to the frame body 221. Rib 251 may be of the same material as the frame body 221 and can be attached by adhesive bonding or other ways. If desired, rib 251 may be made of a different material than frame body 221. By way of example, rib 251 may be a metal material and frame body 221 may be a plastic material. Alternatively, rib 251 may be integrally molded with frame body 221 to provide greater structural strength to form a unitary structure. Rib 251 may be disposed on an upper surface of frame body 221 and extend outwardly from the frame body 221 generally in a plane normal to a centerline traversing the medial-side to lateral-side of the frame body 221. Alternatively, rib 251 may be disposed on a lower surface of frame member 222 and extend downwardly towards the interior of the shroud 238 in plane normal to the centerline as well.

In one arrangement, as shown FIGS. 16A–16C, which are cross-section views of the frame member 222 and sleeve 239, frame member 222 may also have a cross section that varies in regions along its length from the medial side and lateral side. Referring to FIG. 16A, a medial lower region and a lateral lower region of frame member 222 may have a generally flat or planar configuration to form wide base to provide enhanced resiliency with respect to lateral and medial forces acting on the member 222 during forward propulsion of shoe 200. In this configuration, the width of frame member is designated as $w_1$. In this lower region, frame member 222 is formed with the frame body 221 and rib 251 is not included. Further is this lower region, the frame body 221 is generally elongated in the heel-to-toe direction. Referring to FIG. 16B, a middle or central region of frame member 222 still retains the flat configuration and includes a portion of rib 251 integrally molded therewith. The portion of the rib 251 extends from the upper surface of member 222. The width of frame member 222 in this configuration is designated as $w_2$. It should be recognized width $w_2$ is less than width $w_1$, as measured relative from midsole 214 traversing along the perimeter of frame member 222. With reference to FIG. 16C, frame member 222 may have a generally curvilinear shape with a portion of rib 251 also extending from the upper surface of frame body 221, and preferably from outermost tip portion. As can been appreciated, width $w_3$ is the smallest of the widths, $w_1$, $w_2$. It should be appreciated that the central region of frame member 222 extends between the medial lower region and the lateral lower region of frame member 222. The configuration of the medial lower region, the center region, and the lateral lower regions of frame member 222 cooperate together to provide a varied tenting resistance in each region while lowering the weight of the shoe 200. By way of example, the section modulus of the frame member 222 in a plane extending through the member 222 can be adjusted in the regions. The center region of frame member 222 may have a greater section modulus to resist more force, while the medial lower region and lateral lower region of frame member 222 can have a small section modulus for lower forces.

FIGS. 17–21 illustrate an alternative embodiment of the present invention. An article of footwear is provided with a removable or interchangeable shroud system 338. The shroud system 338 provides a number of advantages for a user and/or manufacturers of footwear. The shroud system can be selectively changed to provide different aeration configurations depending on the type of material in which the shroud material is formed. For example, a user may desire a shoe configured with a shroud system, which provides greater air flow to the foot therein during hot or warm ambient weather conditions. Likewise, if desired, a shoe may be configured with a shroud system that may provide less air flow to the foot during colder climate conditions.

As shown in FIGS. 17–21, a shoe 300 includes the shroud system 338 having a biasing structure that substantially conceals and provides aeration for the foot of a wearer within a foot bootie system 346. Shroud system 338 covers or protects the forefoot portion to the rearfoot portion of a foot bootie system 346 extending above the sole 310. Shroud system 338 includes a frame member 322 in a sleeve 339 extending from the medial side 16 and lateral side 18 of shoe 300, shown in FIG. 19. Frame member 322 functions to urge a portion of shroud system 338 away from the foot of the wearer to provide an aeration space 304 (see FIGS. 19–20) enveloping around the foot bootie system 346 above sole 310. Preferably, at least a forefoot portion of the shroud system 338 is biased away from the foot of the wearer.

In this embodiment, frame member 322 includes a medial end 323 and a lateral end 325 which are coupled to the medial side 16 and lateral side 18 of the shroud system 338, respectively, rather than the foot holding system (see FIG. 9) or the sole (see FIGS. 1–8, and 14). In one arrangement, the lower ends of sleeve 339 are enclosed thereby forming an integral pocket-like portion to couple the medial end 323 and lateral end 325 to shroud system 338. The pocket-like portion generally restrains the ends 323, 325 from side-to-side movement with respect to the sleeve 339.

Figure 18:
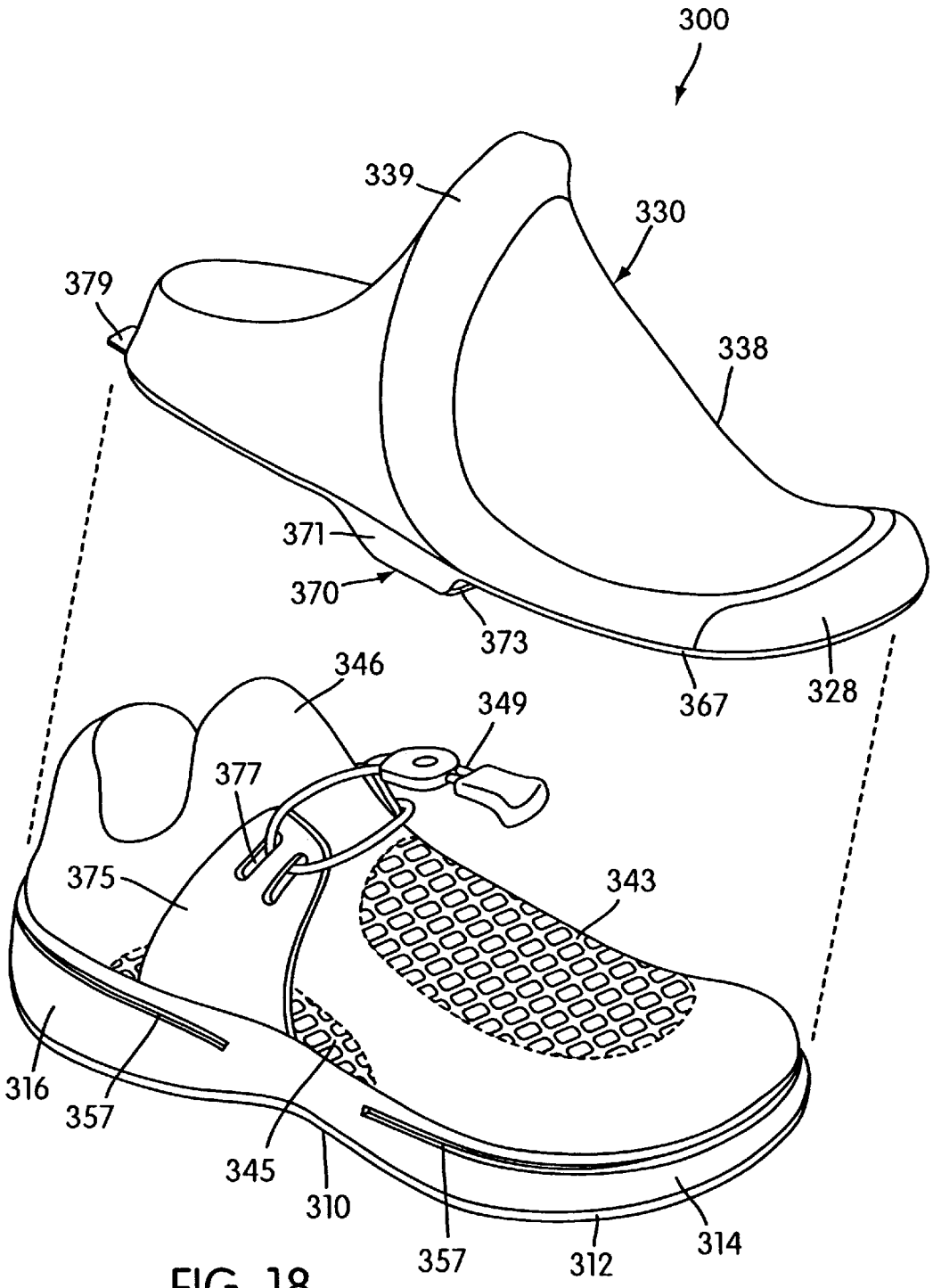
FIG. 18 is a schematic exploded assembly view of the article of footwear of FIG. 17.
Figure 19:
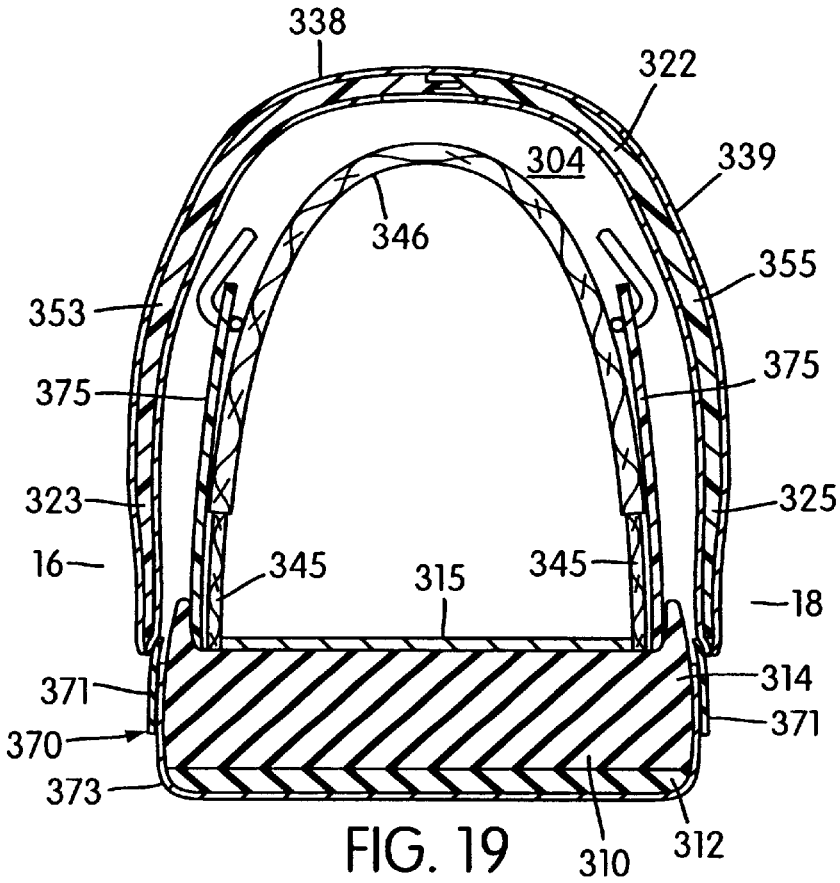
FIG. 19 is a cross-section view of the article of footwear of FIG. 17 taken along line 19—19.
Figure 20:
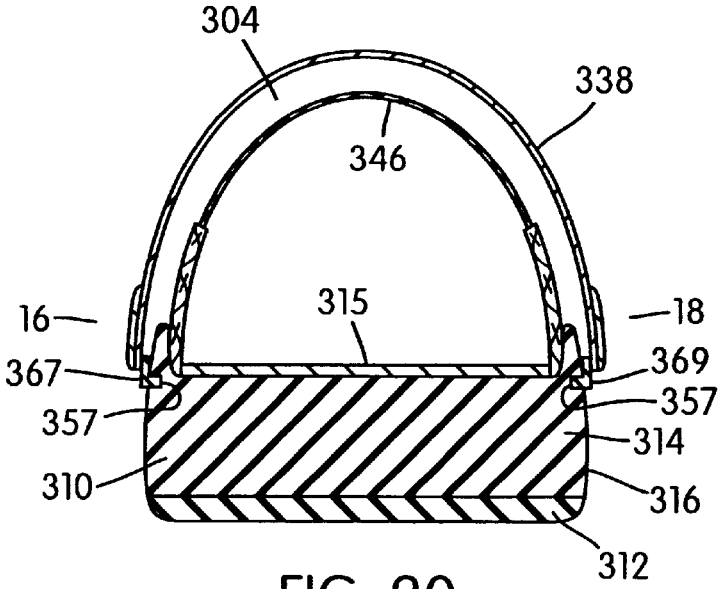
FIG. 20 is a cross-section view of the article of footwear of FIG. 17 taken along line 20—20.

In one arrangement, shown in FIGS. 18–20, shroud system 338 is removably positionable on sole 310 by a tongue and groove system. The lower periphery of the shroud 338 includes a flexible lower band 367 which interlocks and mates with a corresponding grooved structure 357 as shown in FIG. 20. Groove 357 is disposed on sole 310 and serves to attach shroud 338 directly to sole 310 of foot bootie system 346, preferably at midsole 314. To perform the mating function, it lower band 367 includes a mating portion or tongue portion 369 that extends inward to interlock or fit within the groove 357. The flexible lower band 367 is sized to providing an inward compression bias around the sole 310. This can compression bias can be accomplished by providing the band 367 with a circumferential distance that is less than the circumferential distance of the sole 310 with groove 357 therein. Hence, the flexible lower band 367 can be stretched to fit within the groove 357.

In the illustrated embodiment, the tongue portion 369 is disposed circumferentially around the forefoot region and the rearfoot region of shroud system 338. Lower band 367 may be fixely attached to shroud system 338 in a conventional manner, such as sewing, adhesive or chemical bonding. Lower band 367 may be constructed of a desirable material, such as rubber, an elastomeric material, rubber, or other similar materials.

As shown in FIG. 18, groove 357 may be disposed on the foot region and rearfoot region of the midsole 314. In one arrangement, the arch area of midsole 314 may be devoid of a groove. Groove 357 may extend peripherally from medial side 16 to the lateral side 18 of the forefoot region of the midsole 314. Likewise, groove 357 may extend peripherally from the medial side 16 to the lateral side 18 of rearfoot region of the midsole 314. It should be appreciated that the periphery of midsole 314 includes a peripheral side surface 316, which is generally exposed.

Figure 21:
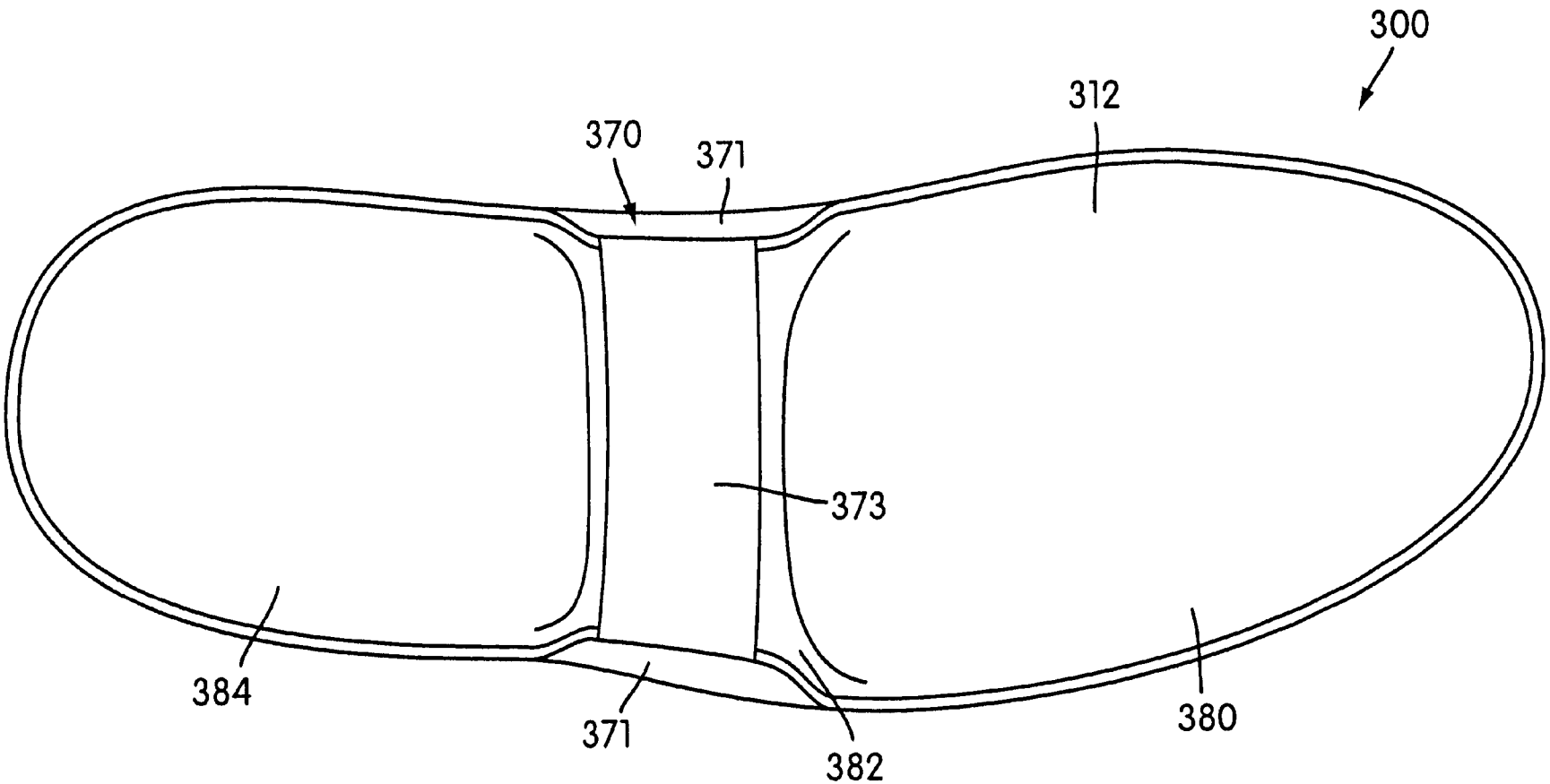
FIG. 21 is a schematic bottom plan view of the article of footwear of FIG. 17.

Referring to FIG. 21, outsole 312 includes a forefoot portion 380, a raised arch portion 382, and a rearfoot portion 384. Forefoot portion 380 and rearfoot portion 384 provide for a lower ground engaging surface generally configured for traction. Raised arch portion 382 provides a lower surface which does not contact a ground surface.

With reference to FIGS. 18, 19 and 21, lower band 367 includes may include a sole engaging strap 370 which extends below and around the raised portion of the sole 310 in the midfoot region transversely connect the medial side 16 and lateral side 18 shroud system 338. In an arrangement, sole engaging strap 370 may be formed with tensioning members 371 and an elastic band 373. The tensionsing members 371 are disposed on the lateral side 18 and the medial side 16 of sole 310 that extend downwardly from the midfoot region of midsole 314. As shown in FIG. 19, the distal ends of tensioning members 371 are attached to the elastic band 373. Elastic band 373 may be constructed of an elastic or resilient material. The ends of bands 373 may be attached tensioning members 371 by a desirable method, such as adhesive bonding, sewing, or chemically fused.

In operation, elastic band 373 engages the sole 310 and preferably the outsole 312 of shoe 300 in raised arch portion 382 that does not contact the ground surface. The arrangement of the sole engaging strap 370 serves to exert tensile forces on the lateral side 18 and medial side 16 of shroud 338. This arrangement can hold shroud system 338 downwardly against sole 310. Additionally, tensioning members 371 and elastic band 373 assists in holding the lower band 367 within the groove 357 and tongue portion 369 downward against a horizontal surface of groove 357 as seen in FIG. 20. It should be appreciated that shroud system 338 can be held against sole 310 by (a) sole engaging strap 370; (b) the tongue and groove system; or (c) a combination of both as shown in the FIGS. 18–21.

Figure 17:
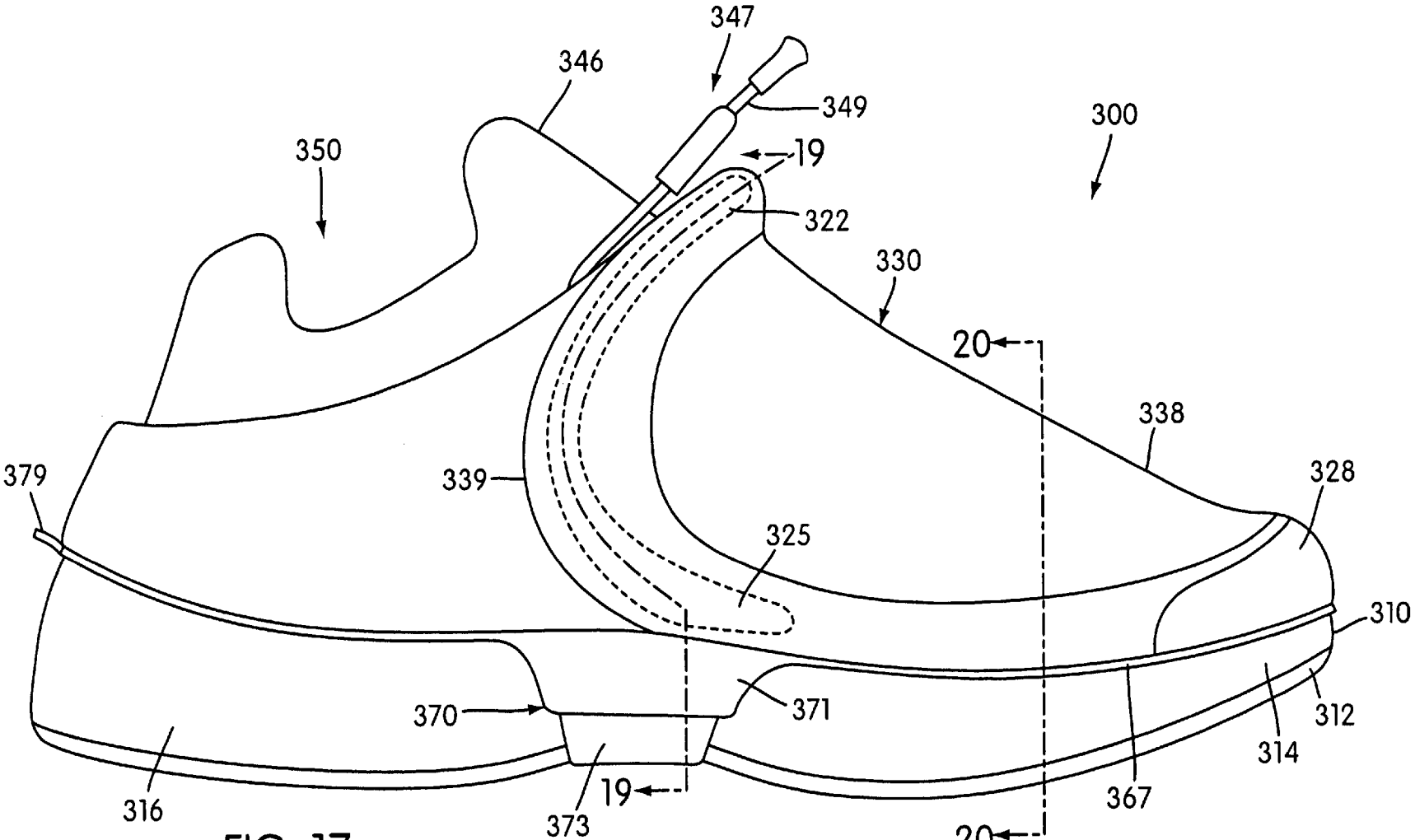
FIG. 17 is a schematic side elevational view of an alternative embodiment of an article of footwear with a removable upper arrangement.

With reference to FIGS. 17 and 18, lower band 367 may include a rearwardly disposed gripping element 379. Gripping element 379 may be a planar member extending away from lower band 367. Gripping element 379 facilitates a user to grasp thereon for assisting removal and attachment of shroud system to foot bootie system 346. To attach shroud system 338 to sole 310, the forward toe area of foot bootie system 346 is inserted between shroud 330 and elastic band 373. The user may grasp the gripping element 379 and pull the rearfoot portion of shroud 330 and lower band 367 towards and into groove 357.

With reference to FIG. 19, frame member 322 may have a multi-part configuration similar to the embodiment shown in FIG. 13. In FIG. 19, frame member 322 may be formed by a lateral portion 355 and medial portion 353 interfitted or removably coupled together in a friction fit or force fitting arrangement. The multi-part configuration facilitates the shroud system 338 to be folded in which the medial side 16 and lateral sides 18 come into contact. To accomplish the folding operation, the two portions 353, 355 of the frame member 322 are separated apart from each other or otherwise removeably separable. Once the members are separated, the shroud system 338 generally loses tautness. In one arrangement, a forefoot portion of shroud system 338 may become flaccid for the folding operation. The shroud system 338 in the folded configuration facilitates the storage of multiple shrouds for later use with shoe 300. To unfold shroud system 338, medial portion 353 and lateral portion 355 are brought into an abutment relation and interfitted together. This unfolding action facilitates shroud system 338 to become taut by frame member 322. It should be recognized that frame member 322 may be constructed from a single member as well to provide the tautness to shroud system 338.

As shown in FIG. 18, shoe 300 may further include a foot fastening system 347 for tightening the foot of the wearer against the sole 310 via footbed 315. Foot fastening system 347 preferably includes a tensioner 349 with compression members 375 disposed on the medial side 16 and lateral side 18 of shoe 300. The fixed end of compression members 375 are mounted to the sole 310, preferably to the midsole 314 of shoe 300. The free end of compression members 375 have elongated eyelets 377 which are engaged by tensioner 349 in a conventional manner. By way of example, when tensioner 349 is pulled taut, the free end of compression members 375 bend inward from the medial side and the lateral side to abut foot bootie system 346 between the compression members 375. This action places compressive forces of the foot bootie system 346 and the foot of the wearer.

The compression members 375 may be constructed of a semi-flexible material, such as plastic. Alternatively, the compression members 375 can be formed by a semi-rigid material. As illustrated in FIG. 17, a portion of tensioner 349 may extend outward from underneath the shroud system 338. In an alternative arrangement, the fastening system 347 can include a lace loop configuration as shown in reference to the embodiment in FIG. 9. Alternatively, the fastening system 347 can includes a tensioner with eyelets on the foot bootie system material as shown in reference to the embodiment in FIG. 13.

If desired, foot bootie system 346 may include a forefoot aeration region 343 and/or side aeration regions 345 on the medial side 16 and lateral side 18. Aeration regions 343 and 345 may have a similar construction as the embodiment shown in reference to FIG. 9.

While the various features of the embodiments of the article of footwear operate together to achieve the advantages previously described, it is recognized that individual features and sub-combinations of these features can be used to obtain some of the aforementioned advantages without the necessity to adopt all of these features. It should be recognized that the shrouds 38, 138, 228, and 330 may include an air permeable material which conveys air inside of the respective shrouds. The embodiments reference in the FIGS. 1–21, the shrouds can be spaced from the foot holding systems at least a distance of 0.25 inches as measured from a center point of a frame member in a plane of the frame member 22, 122, 222, and 322 to the foot holding system. Alternatively, the spaced distance from the foot holding system from a center point of the frame member may range at least 0.50 inches, at least 1.0 inch, or, at least 1.5 inches. In these arrangements, the air circulation space around the foot of the wearer can be adjusted for different type of sports and ambient air conditions.

While the present invention has been described with reference to preferred and exemplary embodiments, it will be understood by those of ordinary skill in the art that various changes may be made and equivalents may be substituted for elements thereof without departing from the scope of the invention. In addition, many modifications may be made to adapt a particular situation or material to the teachings of the invention without departing from the scope thereof. For example, it is contemplated with that any foot holding system or foot engaging systems described herein may be used with any of the shrouds, shroud systems and frame members, biasing members described herein. Therefore, it is intended that the invention not be limited to the particular embodiments disclosed, but that the invention will include all embodiments falling within the scope of the appended claims.

What is claimed is:

1. An article of footwear; comprising:

a sole;

a shroud for covering a foot of a wearer;

a foot holding system extending outward from said sole; and a frame member for urging said shroud away from the foot of the wearer, said frame member having a medial end and a lateral end coupled to the foot holding system.

2. The article of footwear of claim 1, wherein said foot holding system includes a foot bootie.

3. The article of footwear of claim 2, wherein said foot bootie includes an adjustable foot fastening system for fastening said foot of said wearer to said sole.

4. The article of footwear of claim 3, wherein said adjustable foot fastening system includes a closed loop tensioning member.

5. The article of footwear of claim 3, wherein said adjustable foot fastening system includes lacing system.

6. The article of footwear of claim 2, wherein said foot bootie includes an aeration region with open mesh material for receiving air therethrough.

7. The article of footwear of claim 1, wherein said frame member includes at least a medial portion and a lateral portion interfitting together.

8. The article of footwear of claim 1, wherein said shroud covers at least a forefoot portion of said foot holding system.

9. The article of footwear of claim 1, wherein said frame member has a length in the direction from a medial side and a lateral side of said sole, and said frame member includes at least a variable cross section along its length.

10. The article of footwear of claim 1, wherein said shroud includes a sleeve sized for receiving said frame member, said sleeve having a medial outlet and a lateral outlet for said medial end and said lateral end of said frame member extending from the medial outlet and the lateral outlet, respectively.

11. An article of footwear, comprising:

a sole having a midsole;

a shroud for covering a forefoot portion and at least a midfoot portion of a foot of a wearer;

a frame member for tensioning said shroud away from said forefoot portion and said at least a midfoot portion of said foot of said wearer, said frame member being attached to said midsole; and a foot holding system for holding the foot of the wearer to said sole.

12. The article of footwear of claim 11, wherein said frame member is coupled to a medial side and a lateral side of said midsole.

13. The article of footwear of claim 12, wherein said frame member includes a length in a direction traversing said medial side and said lateral side, said frame member having a variable cross-section along said length.

14. The article of footwear of claim 12, wherein said frame member includes a frame body and a rib, said frame body having an upper surface and an opposing lower surface.

15. The article of footwear of claim 14, wherein said rib is disposed on said upper surface of said frame body.

16. The article of footwear of claim 12, wherein said frame member includes a medial portion disposed on said medial side and a lateral portion disposed on said lateral side, said medial portion and said lateral portion of said frame member capable of being interconnected together.

17. The article of footwear of claim 11, wherein said shroud includes a sleeve for retaining said frame member therein.

18. The article of footwear of claim 11, wherein said foot holding system includes an adjustable foot fastening system for tightening said foot of said wearer against said sole.

19. The article of footwear of claim 18, wherein said adjustable foot fastening system includes a lacing system.

20. The article of footwear of claim 18, wherein said adjustable foot fastening system includes an adjustable tensioner attached to said foot holding system.

21. The article of footwear of claim 12, further including a foot fastening system for tightening said foot of said wearer to said sole, said foot fastening system extending from said midsole.

22. The article of footwear of claim 21, wherein said foot fastening system extends from said midsole, and said foot fastening system includes a medial compression member disposed on said medial side and a lateral compression member disposed on said lateral side.

23. The article of footwear of claim 11, wherein said frame member and said shroud is removable from said midsole.

24. The article of footwear of claim 11, wherein said foot holding system further includes a forefoot aeration region having an air permeable material for receiving air therethrough.

25. The article of footwear of claim 24, wherein said foot holding system further includes a medial aeration region and a lateral region including said air permeable material.

26. An article of footwear, comprising:

a sole having a midsole including a midsole periphery;

a shroud system for covering a foot of a wearer, said shroud system being coupled to said midsole periphery;

a frame member for tenting said shroud system from said foot of said wearer; and a foot holding system for holding said foot of said wearer to said sole.

27. The article of footwear of claim 26, wherein said frame member includes a lateral end and a medial end, said lateral end and said medial end being attached to said shroud system.

28. The article of footwear of claim 27, wherein said shroud system is removable from said midsole periphery.

29. The article of footwear of claim 26, wherein said shroud system includes an tongue portion disposed on a bottom periphery of said shroud system and said midsole periphery includes a grooved portion, said tongue portion is capable of being removably attachable to said grooved portion.

30. The article of footwear of claim 29, wherein said shroud system further includes a gripping element for said wearer to grasp thereon, said gripping element disposed on a rearward portion of said bottom periphery of said shroud system.

31. The article of footwear of claim 26, wherein said sole further includes an outsole having a forefoot portion, a raised arched portion, and a rearfoot portion, said forefoot portion and said rearfoot portion configured for engaging a ground surface, said shroud system further including an sole strap for engaging said raised arched portion between a lateral side and a medial side of said outsole.

32. The article of footwear of claim 26, further including an adjustable foot fastening system extending from said midsole, and said adjustable foot fastening system including a medial compression member and a lateral compression member, said medial compression member is disposed on a medial side and said lateral compression member is disposed on a lateral side of said foot holding system.

33. The article of footwear of claim 32, wherein said adjustable foot fastening system further includes a closed loop and a tensioning member.

34. The article of footwear of claim 33, wherein said foot holding system includes a foot bootie extending from said sole.

35. The article of footwear of claim 26, wherein said midsole periphery of said midsole further includes a locating groove, and said sole further includes a raised arch portion, said shroud system further includes an attachment member disposed on a lower periphery of said shroud system, said attachment member for interfitting in said locating groove, and said shroud system further including a strap for engaging said raised arch portion between a lateral side and a medial side of said sole.

36. An upper system for an article of footwear, comprising:

a shroud for covering at least a forefoot portion and a midfoot portion of a foot of a wearer, said shroud being configured to be removably coupled to said article of footwear; and a frame member for tenting said shroud from said at least a forefoot portion and said midfoot portion of said foot of said wearer, said frame member having a lateral end and a medial end being coupled to a lateral side and a medial side of said shroud, respectively.

37. The upper system of claim 36, wherein said shroud includes a locating member for removably coupling said shroud to said article of footwear, said locating member being disposed on a bottom periphery of said shroud.

38. The article of footwear of claims 37, wherein said shroud further covers a rearfoot portion of said foot of said wearer.

39. The article of footwear of claim 36, wherein said shroud further includes a transverse bottom strap extending between the medial side and the lateral side.

40. An article of footwear, comprising:

a sole including a midsole;

a shroud extending from said sole for enclosing at least a forefoot portion of a foot of a wearer therein;

means for tenting a portion of said shroud away from the foot of said wearer; and means for holding the foot of said wearer against said sole;

wherein said means for holding the foot includes a foot bootie.

41. The article of footwear of claim 40, wherein said means for tenting includes at least one frame member coupled to said shroud and to said sole.

42. The article of footwear of claim 40, wherein said means for tenting includes a plurality of frame members coupled to said shroud and to said sole.

43. The article of footwear of claim 1, wherein said frame member is spaced from the foot holding system by at least a distance of 0.25 inches.

44. The article of footwear of claim 11, wherein said frame member is spaced from said foot holding system by at least a distance of 1.0 inch.

* * * * *

UNITED STATES PATENT AND TRADEMARK OFFICE

CERTIFICATE OF CORRECTION

PATENT NO. : 6,754,983 B2
DATED : June 29, 2004
INVENTOR(S) : Tinker L. Hatfield et al.

It is certified that error appears in the above-identified patent and that said Letters Patent is hereby corrected as shown below:

Title page,
Item [56], References Cited, U.S. PATENT DOCUMENTS,
please add the following references:

| | | |
|---|---|---|
| --11,947 | 11/1854 | Pease |
| 757,424 | 04/1894 | Vohl |
| 1,258,629 | 05/1918 | Bliss |
| 4,677,767 | 07/1987 | Darby |
| 5,497,564 | 05/1996 | Allen et al |
| 5,659,982 | 08/1997 | Muraoka et al |
| 5,704,138 | 01/1998 | Donnadieu |
| 5,926,978 | 07/1999 | Smith |
| 6,029,376 | 02/2000 | Cass |
| D47,238 | 04/1915 | Miller |
| 4,908,963 | 03/1990 | Krajcir et al |
| 5,878,511 | 03/1999 | Krajcir |
| 3,102,347 | 09/1963 | Griswold et al |
| 1,952,294 | 03/1934 | Strauss |
| 1,663,319 | 03/1928 | Snell |
| 2,160,768 | 05/1939 | Wasser |
| 2,392,867 | 01/1946 | Stoner et al |
| 4,656,761 | 04/1987 | Lord |
| 4,231,170 | 11/1980 | Griswold |
| 3,175,311 | 09/1965 | MacQuaid |
| 1,900,515 | 03/1933 | Miller |
| 2,015,479 | 09/1935 | Koomruian |
| 494,598 | 04/1983 | Russell |
| 4,972,610 | 11/1990 | Tong |
| 5,467,537 | 11/1995 | Aveni et al |
| 6,237,250 | 05/2001 | Aguerre-- |

Signed and Sealed this

Thirty-first Day of May, 2005

JON W. DUDAS
*Director of the United States Patent and Trademark Office*